US011353293B2

(12) United States Patent
Lenz

(10) Patent No.: US 11,353,293 B2
(45) Date of Patent: Jun. 7, 2022

(54) CAMOUFLAGE PATTERN SCHEME FOR CAMOUFLAGE PATTERNS ON OBJECTS

(71) Applicant: Florian Lenz, Langebrück (DE)

(72) Inventor: Florian Lenz, Langebrück (DE)

( * ) Notice: Subject to any disclaimer, the term of this patent is extended or adjusted under 35 U.S.C. 154(b) by 0 days.

(21) Appl. No.: 15/345,014

(22) Filed: Nov. 7, 2016

(65) Prior Publication Data

US 2017/0299341 A1 Oct. 19, 2017

Related U.S. Application Data

(63) Continuation-in-part of application No. 12/863,666, filed as application No. PCT/EP2009/000348 on Jan. 21, 2009.

(30) Foreign Application Priority Data

Jan. 21, 2008 (DE) ..... 102008005802.5
Mar. 21, 2008 (DE) ..... 102008002811.8

(51) Int. Cl.
*F41H 3/00* (2006.01)
*F41H 3/02* (2006.01)

(52) U.S. Cl.
CPC ..... *F41H 3/00* (2013.01); *F41H 3/02* (2013.01)

(58) Field of Classification Search
CPC ..... F41H 3/00
USPC ..... 428/919
See application file for complete search history.

(56) References Cited

U.S. PATENT DOCUMENTS 2,190,691 A 2/1940 Barclay
2,292,848 A 8/1942 Robson
4,212,440 A 7/1980 Ferris
D345,467 S 3/1994 Walsh
5,675,838 A 10/1997 Hollinger
5,972,479 A * 10/1999 Lehman ..... F41H 3/00 345/634
D472,391 S 4/2003 Romero Femenia
(Continued)

FOREIGN PATENT DOCUMENTS

GB 1595615 8/1981

OTHER PUBLICATIONS

Hyperstealth, "Lightning and Thunder Disruption Camouflage Pattern", Mar. 24, 2006; http://www.hyperstealth.com/ADP/ (Year: 2006).*

(Continued)

*Primary Examiner* — Laura C Powers
(74) *Attorney, Agent, or Firm* — Greer, Burns & Crain, Ltd

(57) ABSTRACT

A camouflage object including a body having an area and a camouflage pattern placed in the area. The camouflage pattern is formed by at least two first bands extending in the same first running direction across the area and having a first length, where the at least two first bands include a first perceptible characteristic and at least one second band extending in a second running direction across the area and having a second length, where the at least one second band includes a second perceptible characteristic. The at least one second band at least partially overlaps the at least two first bands. A plurality of zones is formed by the intersection of the at least two first bands and the at least one second band and have a pattern formed by the combination of the first perceptible characteristic and the second perceptible characteristic.

20 Claims, 28 Drawing Sheets

(56) References Cited

U.S. PATENT DOCUMENTS

| | | | | |
|---|---|---|---|---|
| 6,562,739 | B1 * | 5/2003 | Correll | D06N 3/0059 2/900 |
| 6,805,957 | B1 | 10/2004 | Santos et al. | |
| 2004/0187186 | A1 | 9/2004 | Boezi | |
| 2006/0112606 | A1 * | 6/2006 | Lauer | F41H 3/02 42/96 |

OTHER PUBLICATIONS

"Flames of War"https://www.flamesofwar.com/Default.aspx?tabid=110&art_id=285 (Year: 2006).*

HyperStealth SpecAm-Desert Viper, "Desert Vipers in the Sand", Oct. 1, 2005; 3 pages; http://www.hyperstealth.com/specops1/desert/index.html.

HyperStealth SpecAm-Tropical, "Something Wicket This Way Comes: New Sepcial Operations (SpecAm) Digital Camo", Aug. 17, 2005; 4 pages; http://www.hyperstealth.com/specops1/index.html.

HyperStealth Global SpecAm-Desert Camouflage, "Satellite Determined-Region Specific SpecAm Camouflage", Oct. 8, 2005; 11 pages; http://www.hyperstealth.com/specam/home/index.html.

Scottish Comer, Scottish Tartan-Bruce patterns, http://www.scotchcomer.com/mill/tartans-b/bruce.html, via Internet Wayback Machine Oct. 21, 2006, http://wayback.archive.org/web/20061021203524/http://www.scotchcorner.com/mill/tartans- b/bruce.html.

Jamiacan Flag document; http://www.flags-flags-flags.org.uk amaican-flag.htm.

* cited by examiner

FIG. 30A
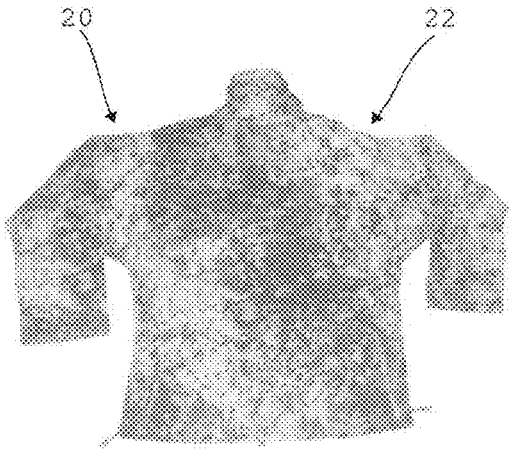
FIG. 30B
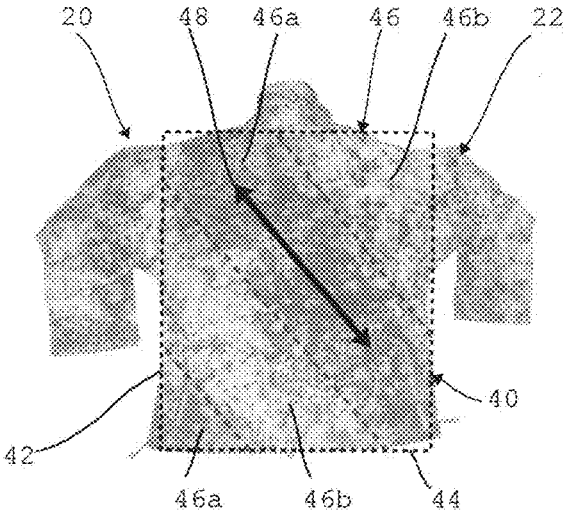
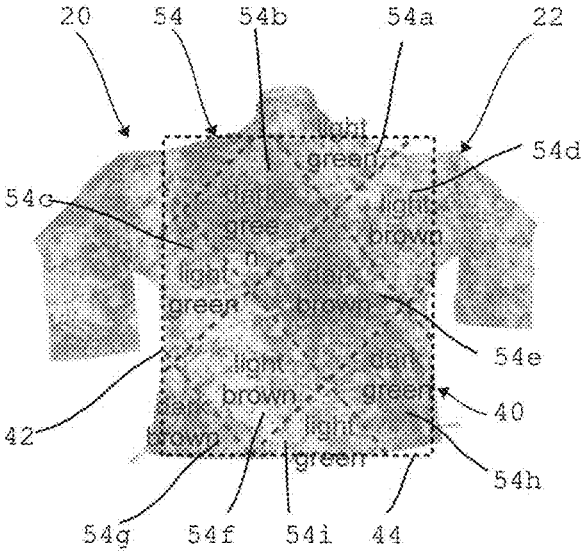
FIG. 30D
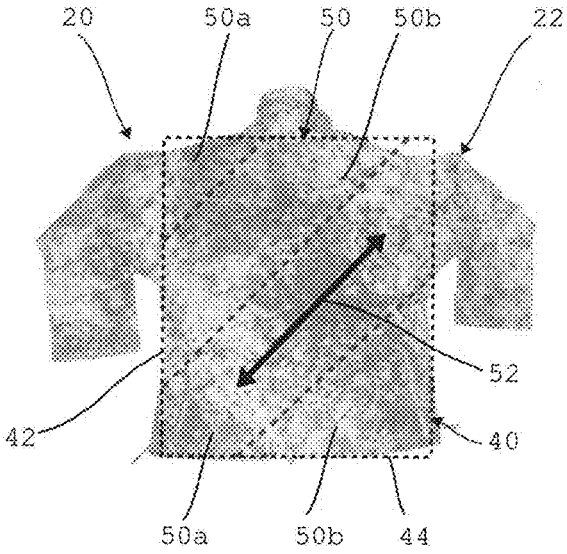
FIG. 30C

FIG. 31A
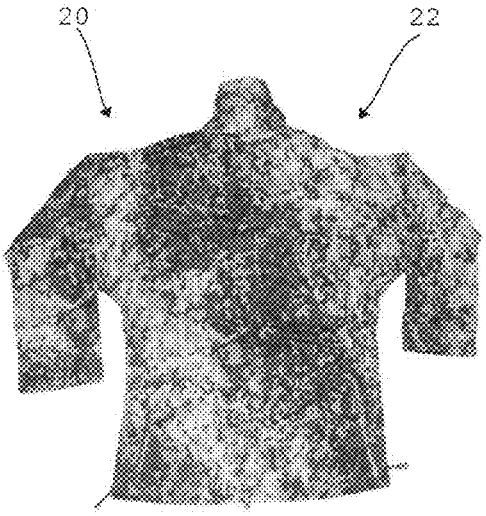
FIG. 31B
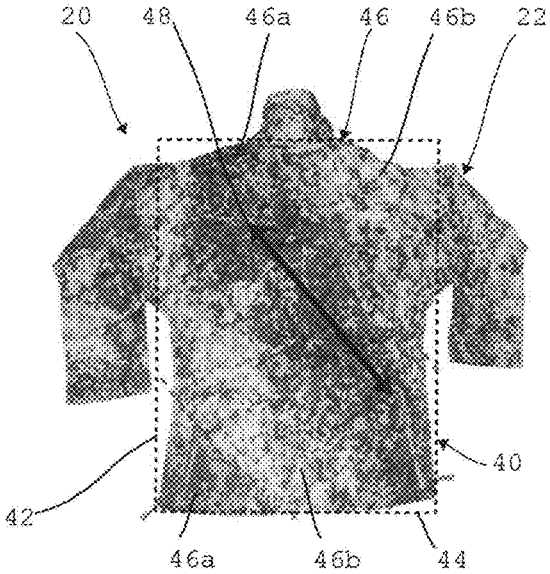
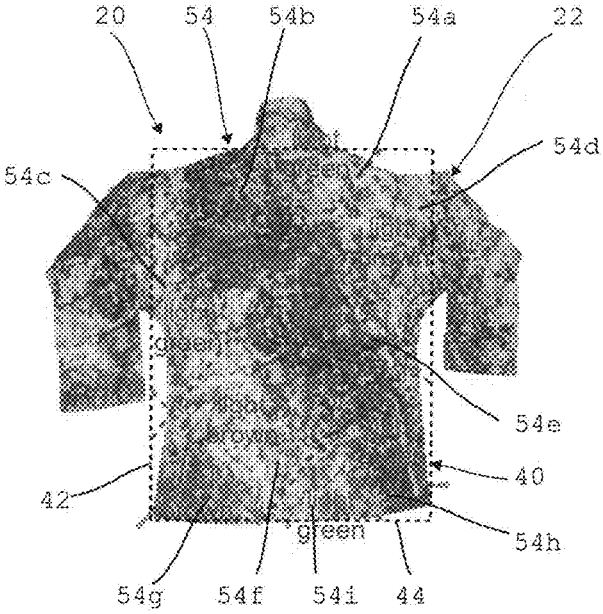
FIG. 31D
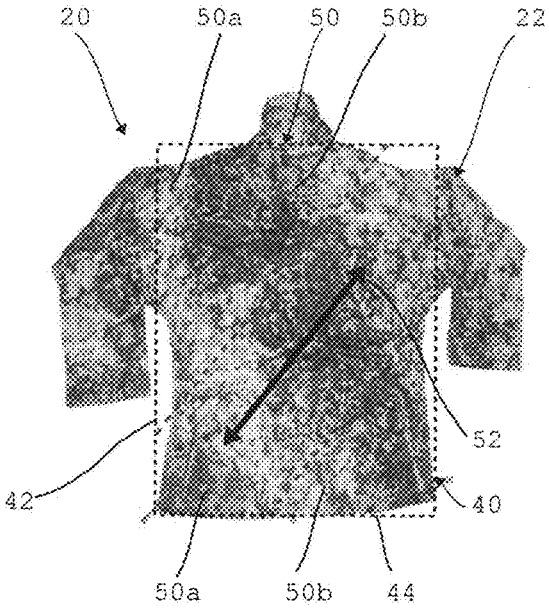
FIG. 31C

FIG. 32A
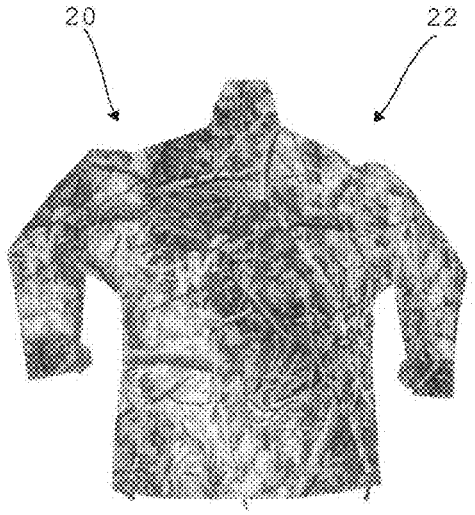
FIG. 32B
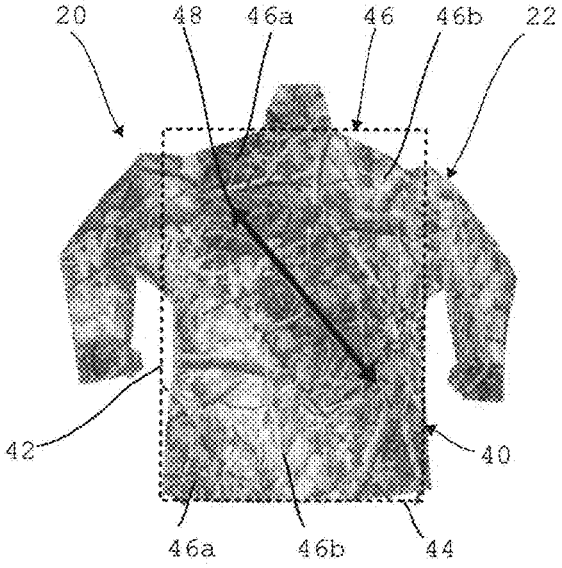
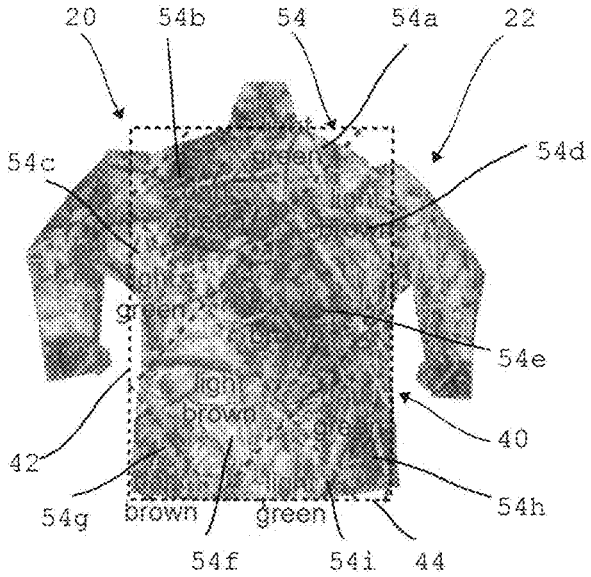
FIG. 32D
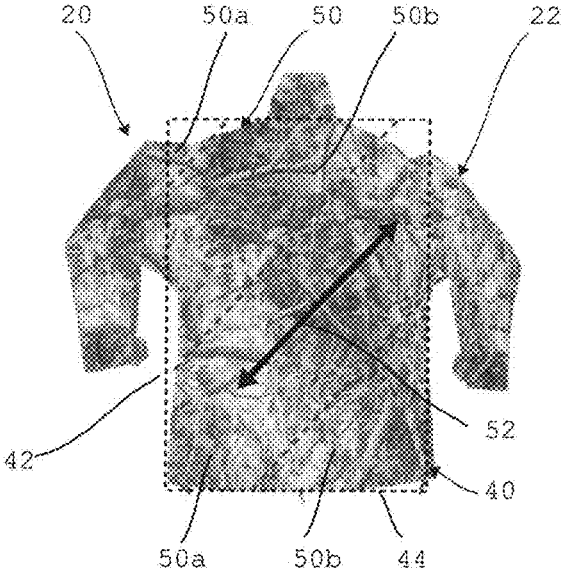
FIG. 32C

CAMOUFLAGE PATTERN SCHEME FOR CAMOUFLAGE PATTERNS ON OBJECTS

CROSS REFERENCE TO RELATED APPLICATIONS

This application is a continuation-in-part application of U.S. patent application Ser. No. 12/863,666 filed on Sep. 3, 2010, which is a National Stage application of International Application No. PCT/EP2009/000348 filed on Jan. 21, 2009, all of which are incorporated herein by reference in their entireties.

BACKGROUND

A camouflage pattern scheme for camouflage patterns on objects such as clothing, surfaces, buildings, ground vehicles, aircraft and watercraft and superstructures thereof.

Various camouflage patterns have been known. The document U.S. Pat. No. 6,805,957 describes a disruptive camouflage pattern system to be used for both military and civilian applications. The system includes specialized techniques for printing the camouflage pattern system onto the fabric. The system provides camouflage in both the human visible light and the near infrared range. The system depends on a macro pattern resulting from a repeat of a micro pattern. The coloring used includes at least four colorings from dyes that in combination produce a percent reflectance value comparable to that of the negative space surrounding the camouflaged subject. The system functions by way of a macro pattern being disruptive of the subject's shape and a micro pattern having sharp-edged units of a size capable of blending into the subject's background.

Basically, two known optional solutions exist which all of the approaches to camouflage have been applying to date in various modes.

A first, known approach relates to blended colors and color mixtures. One approach involves the formation of a blended color matched to a specific tactical environment or specific surroundings such as plain-colored sets of clothes or color mixtures which, at increasing distances, result in an impressionistic appearance from relatively small adjacent color areas such as "MARPAT", "ARPAT" and "BW-Flecktarn (German Armed Forces/spotted camouflage)". All of these attempts aim at achieving the most inconspicuous design of all of the indicia features of the object to be camouflaged relative to the background so as to make the entire object disappear. This method suffers from the drawback that although the object is visible in a comparatively large surrounding region, even if to a lesser degree than non-camouflaged objects, it will in this entire region always be visible as a whole. A particularly conspicuous example is ARPAT that although it blends in with every environment it will never do so perfectly.

All of the known clothing suits including "MARPAT" and high-contrast suits such as "US Woodland", "US Tiger Stripe", "Wehrmacht-Splintertarn (German armed forces-splinter camouflage)" will appear as a blended color from a specific distance although according to the inventor a shape-disrupting macro pattern is incorporated e.g. in particular in "MARPAT". However, the incorporated color spots of the macro pattern do not appear any larger than those of the Woodland pattern. This distance is in fact longer than in most of hunter's suits whose details merge into one mass already from a few meters away such as in Realtree™ and Advantage™ such that a conspicuous shape will be visible though to a minor degree (ca. 20 to 30 m). This does not mean that from more than 20 to 30 meters no separate pattern spots will be visible but that no actual disruption of the shape will occur, resulting in a color mixture. Furthermore, in all of the known suits the proportions of color spots do not continuously match from near to far but only at a specific distance.

Of all the clothing suits known thus far the shape is disrupted most in the earliest patterns of the US trademark Predator™. What is a problem when breaking up shapes by way of sharply defined areas alone such as in US-Woodland, Predator™ or Wehrmacht-Splinter pattern is that for one, these areas are much more conspicuous in movement than fuzzy area outlines or irregular/frayed areas such as in MARPAT. For another, too stark large-area contrasts are per se already conspicuous since the space arrangement and the rhythm of the areas do not match those of the surroundings. This effect is similar to a warning signal on a road. In the case of too fuzzy area outlines, e.g. due to barely contrasting colors, the contrast between these areas is attenuated so as to result in reduced shape break-up and ultimately in plain-colored clothing such as with the "BW-Flecktarn" or "Mossy-Oak™ patterns".

Color mixtures also suffer from the drawback that they basically only function in planar areas. However, since virtually every object to be camouflaged, in particular the human body, is three-dimensional, there will always be too bright and too dark areas. Since these are distributed in congruence to the shape, meaning e.g. the shoulders are lighted up by incident light, in contrast to the underarms which appear dark from the shadow, the body will be perceived more easily. One option is to work with several different patterns, incorporating these in the suit design so as to create a counter-shade similar to that of a shark to avoid a bulk presentation of the body. However, this would for one increase efforts and for another involve less than perfect solutions since humans are not positioned in space in one position/posture at all times as a shark is but they will take different positions/postures in their space e.g. they will be standing, lying prone/on their back, squatting, arms close/spread out.

A second known approach is a specialized color composition. This means a highly specialized adaptation to a specific background. Although this method, for which wildlife offers many examples with specialized animals having adapted to specialized habitats, can provide baffling results, it is associated with a constantly increasing attachment to location or remaining stationary. This is impractical for most applications in particular where camouflage clothing is concerned since the considerable trouble makes it unlikely for the user to keep changing or carrying many different sets of clothes. The backgrounds and thus the properties keep changing e.g. brown-green, light-dark, grass-leaves, etc., i.e. with this approach the object on the whole will be perfectly invisible while being overly conspicuous in other places. Not only do the backgrounds change in dependence on climate zones or vegetation zones but in a given place they also depend on the visual angle.

The substantial common factor in these two approaches is that as the objects stand out against the background thus becoming visible, they will be visible in their entirety. The consequence is two-fold; for one, the entire area of the object is visible. Thus the size of the visible area will be larger than if only part of the object could be seen. A larger area is, however, more conspicuous than a smaller area. Furthermore, an observer will assess the distance more correctly and thus perceive it as more menacing, which is substantial for aiming at targets and for example in the case of deer for perceiving a menace and thus for the flight response. If the visible area were smaller, this would be inhibited.

For another, an observer will recognize the shape and type of the object. Thus he can assess the object in view of the type, movement, direction of movement and menace, and be able to react deliberately.

Patterns in use thus far are not or insufficiently matched to natural conditions in the features indicated above such as lightness, color, saturation, pattern, structure, and gloss, of the object's background. Repeated assertions notwithstanding, they do not break up the shape of the object but will merge into blended colors already from short distances.

SUMMARY

It is the object of the invention to provide a camouflage scheme for camouflage patterns for objects to be camouflaged that is flexible in use for different sizes of objects to be camouflaged. Camouflage should preferably be possible for any random object such as in particular clothing, surfaces, ground vehicles and air- and watercraft. In particular, at least some of the drawbacks described above should be avoided and thus substantially better camouflage be enabled.

This object is solved by a camouflage scheme having the features of claim 1. Preferred embodiments are the subjects of the subclaims. Further preferred configurations can be taken from the embodiments.

The camouflage scheme according to the invention comprises a polygonal scheme area for a camouflage pattern for objects to be camouflaged. The polygonal scheme area of the camouflage scheme is dimensioned such that the polygonal scheme area substantially covers the entire object area of an object to be camouflaged. Therefore, the scheme area is different in every view of the object, i.e., if seen from above and from a side of the object. Furthermore, the scheme area has a first side length comprising a substantial first extension of the object to be camouflaged. The scheme area has a second side length comprising a substantial second extension of the object to be camouflaged. The polygonal scheme area is provided with at least two adjacent property bands both aligned in the same first running direction having specified widths. Each direction and each width is exactly defined by the scheme with is defined by the object. Adjacent property bands differ alternatingly at least in the mode of one perceptible characteristic. The dimensions of the scheme area and the widths of the property bands are sized such that a maximum of only three and in particular only two property bands extend in the scheme area in their entire width.

A camouflage pattern is formed for each view of the object by imaging or projecting the camouflage scheme with its scheme area onto the area or object area of the object to be camouflaged. The object area is preferably entirely contained in the scheme area. In this respect the camouflage scheme forms a specification for creating the patterning of the object to be camouflaged.

The camouflage scheme according to the invention has many advantages. One considerable advantage is that the camouflage scheme is independent of the size of the object to be camouflaged. The camouflage scheme for creating the camouflage pattern is flexible in application to different sizes of objects to be camouflaged, i.e, the scheme is scaled to the size of a particular object, while achieving excellent camouflaging effects for many different object sizes. The camouflage scheme area of the camouflage scheme will be adapted to the object size.

The first side length of the scheme area in particular corresponds to a first extension of the object to be camouflaged, for example to the length or height or width. In the case of a vehicle the first extension of the object to be camouflaged corresponds e.g. to the vehicle body length. Preferably the first side length of the scheme area corresponds to the maximum extension in one direction. Or else it is conceivable for the first side length of the scheme area to correspond to the trough length of an armored vehicle but not to the entire length including the gun barrel.

Preferably the scheme area is configured as a quadrangle and in particular as a rectangle. the first direction or the first running direction in particular extends the length of a lateral edge or a diagonal of the scheme area. Advantageously the side lengths of the quadrangle correspond to a substantial dimension and in particular to a height or width or length of the object to be camouflaged.

Preferred more specific embodiments provide for example diagonals extending through the quadrangle midpoint and/or spaced apart therefrom, straight lines extending about in parallel through the side length midpoints thus forming at least two adjacent and in particular about parallel property bands.

The quadrangle in particular comprises at least one straight line extending approximately in parallel to the lateral edges about through the side length midpoints, thus forming at least two approximately parallel property bands. The approximately parallel property bands may be displaced in particular about parallel to this straight line and/or this diagonal.

The diagonals and/or straight lines may serve as the borderlines of the property bands. Said property band borderlines may be configured continuously or discontinuously, high in contrast, or as fuzzy transitions. The property bands are in particular defined irregularly or regularly.

Preferably the perceptible property of at least one property band is an optical characteristic of the scheme area which optical characteristic may in particular be a pattern, saturation, gloss, color, lightness, and/or structure, ultraviolet, near infrared, or a thermal property. Preferably two adjacent property bands are distinguished by two different degrees of lightness and/or color and/or saturation and/or pattern and/or structure and/or gloss.

Within each separate property band the perceptible property preferably varies within specified limits wherein the mean value averaged over one property band is clearly distinguished from the mean value of the adjacent property band. In preferred configurations the difference is at least 10%, in particular at least 20% and preferably at least 50%. The concrete difference depends on the specific application.

In all of the configurations one of the properties of the camouflage pattern area is preferably present 40 to 60% in one mode and 60 to 40% in another mode with a half and half division being particularly preferred.

In particular, the property bands extending in the same, first running direction are intersected by at least one property band extending in a second running direction such that in particular along the running direction of each particular property band at least one perceptible property of the associated property band is periodically changed, wherein at least one differently perceptible property changes periodically in particular in two immediately adjacent property bands.

The property bands and the property bands of different properties preferably intersect and the property bands and the property bands of the same properties but in different modes extend in particular approximately parallel.

The first running direction and the second running direction intersect in particular at an angle between 15° and 165°, preferably at an angle between 45° and 135°, and particularly preferably at an angle between 75° and 105°. In specific configurations the angle may be perpendicular.

In all of the configurations the widths of adjacent property bands are comparable to one another. The widths of two adjacent property bands differ from one another in particular less than 25%. In all the cases the property bands can in particular be combined with and superimposed onto one another at random.

Preferably at least two property bands are sharply defined relative to one another at least in sections. It is also conceivable for at least two property bands to fuzzily merge into one another at least in sections.

The camouflage scheme can be transferred to existing camouflage patterns and/or incorporated into existing camouflage patterns so as to significantly improve these while e.g. maintaining the character of a uniform for identifying the wearer. The camouflage pattern extends in particular substantially uninterruptedly, continuously, on the surface of the object to be camouflaged.

In particular, the superimposing of property bands with intersecting property bands will result in zones representing intersections of the property bands. These zones are in turn broken down into sub-zones by intersecting, parallel sub-property bands. Zones and sub-zones are configured following a specific scheme: Each resulting zone may be considered an object area to which the above-described camouflage scheme is applied so as to result in fractal interweaving which in turn results in a continuous camouflage effect across many distances. In analogy the sub-zones can in turn be subdivided into sub-sub-zones to achieve any desired fractal interweaving.

Preferably the camouflage scheme serves for surfaces to be processed further such as textile fabrics, camouflage net fabrics, tarpaulins, prefabricated components, wherein the scheme area structures such as parallel property bands, borderlines, zones and sub-zones are preferably not interrupted in any place of the camouflage pattern scheme in cutting or processing the material for the superimposed camouflage scheme to remain intact.

The repeat pattern is in particular between 80 cm and 2.5 m in height and between 60 cm and 2 m in width. In all of the configurations the object area may be shaped as desired.

What is also claimed is a camouflage pattern having a camouflage scheme as described above for an object to be camouflaged. The camouflage pattern may in particular be a composition, consisting of at least two camouflage patterns.

The invention achieves for the indicated application to provide a camouflage pattern for surfaces, ground vehicles, aircraft and watercraft, and camouflage clothing, achieving attenuation of optical and technically aided perception by an observer which may be advantageous in particular in military and hunting applications, nature research projects and in outdoor activities. Due to the optical qualities, use in fashion and recreation and film-making is conceivable as well.

The invention can be described as a principle of generating camouflage patterns which, unlike all the other camouflage patterns existing to date, do not generate any blended color or blended lightness etc. but will always compel an observer to decide between A (invisible) or B (visible). Due to the fact that the object area is divided up at approximate 50% each into large zones of illustrated background properties, the shape will break up into visible and invisible areas in virtually any possible place and at virtually any possible visual angle of the object to be camouflaged for which the pattern has been designed. Although the areas (B) remain visible and will be seen, i.e. perceived as a visual impulse in the optical system of the observer, they will not be consciously noticed, identified, or assessed, since they will be misapprehended or misinterpreted as a part of nature, e.g. a tree stump, thus appearing subjectively insignificant and not interesting. This is why recognition by an observer of the patterns manufactured according to the presently described principle will be clearly poorer compared to all the camouflage patterns known to date.

This will be achieved by way of relativity of conspicuousness: Against a defined background area in specified modes having specific properties, of two same-size and same-shape areas adjacent to one another that one will be more conspicuous against said background area that deviates in its background properties more than the other from the shared background area. Attention will always first be drawn to the more conspicuous area. The other area will recede in relative perception. What is decisive is the relative difference. The effect will occur when one places against a black area a light gray area, i.e. more conspicuous relative to black, and a dark gray area, i.e. less conspicuous relative to black. However, the same happens in analogy with gradual color shades. Thus the decisive factor is not to perfectly emulate the background properties in the area placed in the foreground but it is which of the two areas placed against the background for comparison shows more similarity with the background. In other words, one cannot only make an area disappear by designing it as inconspicuously as possible but also by placing a more conspicuous one next to it.

This is the effect that the invention utilizes. The area to be camouflaged is configured such that in each of the background properties approximately 50% of the area to be camouflaged are configured in a first mode of one background property and approximately 50% in a second, contrasting mode of the property. For a suit for verdant terrain this means a distribution of about 50% light-50% dark, 50% brown-50% green, 50% lines-50% spots. Particular care should be taken for these zones to not be congruent such as light=brown or dark=green, but again that 50% of the light area be brown and 50% green, and likewise regarding the dark and line/spot structure. This is in particular achieved by intersecting property bands. In one more specific embodiment a first portion may comprise an extreme first mode and another, in particular same-size portion, may comprise an extreme second mode which is for example diametrically exactly contrary to the first mode. Thus far, areas to be camouflaged have been configured 100% in a medium mode of a background property.

As a rule, the brown and green bands extend in parallel as irregular color bands. While the light and dark bands also extend as parallel, irregular bands, they intersect the brown and green bands such that four bands intersect one another, making up light green, light brown, dark green, and dark brown zones. The area between line and spot extends between brown and green along one of the thus created borderlines. The borderline "contrast" for example extends along one of the borderlines between light and dark. The borderline "transition" for example extends along the other of the borderlines between light and dark. Furthermore, the zones are defined irregularly so as to impede the observation of movement.

What is particularly conspicuous is elongated parallelograms such as primarily extremities which with the described method are consequently subdivided into smaller areas with no spatial direction such that, as an extreme example of absent spatial guidance for the eye, a disk will have no spatial direction compared to a rectangle which will have a direction in space when "lying". The indicated pattern areas are distributed such that the body is no longer recognizable as such in any position or posture.

The zonal principle begins in the large pattern areas and it can continue down to the smallest pattern areas in the sense of a fractal. Furthermore, due to the interweaving to obtain a fractal pattern relative to the zone size, blending into the background is possible at any distance. Thus at long distances some green bushes may appear as dark spots on the horizon. At short distances one will recognize shadows and foliage. At close distance, leaves and branches. The pattern reflects this.

Furthermore, due to this approach the technique of the surface treatment specification is self-defined by means of the camouflage scheme in analogy to a mathematical equation. It quasi grows along with the size of the object to be camouflaged. It can thus be applied to bags and camouflage clothing as well as to tanks, aircraft, and ships.

The object to be camouflaged is not treated on the basis of axes of symmetry but based on the large object areas of the object bodies of the object. These are the large, geometric base areas of which the shape is composed when viewed from different visual angles. The large object bodies and thus the visible object areas, using the human body shape as an example, are formed by the head, torso, and the four extremities. In the case of a tank these are in a side view, the body trough with the chassis, the side view of the turret, and the barrel. Due to the unstable shapes of objects movable in themselves, such as humans, axes of symmetry can be determined based on anatomy though not in the actually assumed posture which tends to be an asymmetric area and moreover changes from one moment to the next.

This is why the areas of an object to be camouflaged are reduced to those areas that are substantially movable relative to one another though remaining stationary relative to their position in the entire object. In the case of humans this means for example the arms, legs, torso, and head but not e.g. the foot or lower leg relative to the thigh. In the case of a tank, however, only the turret and the barrel are movable relative to the trough and the chassis. This is why in a lateral view it consists of only 3 areas movable relative to one another though stationary: barrel, turret, chassis with trough. Ships substantially have one lateral surface only, as does aircraft. Still, the fractal pattern structure results in a further subdivision of the individual, smaller object parts. Thus for example a gun turret located in the dark field of a ship's camouflage will again be subdivided into single areas and treated by the 50% rule as described above. It will thus be broken down not only against the background of the sea but against the entire ship as well. On the whole it will remain dark though and thus associated with the superimposed dark field.

The extent to which this fractal approach is elaborated, depends on the intended possible nearness to an observer up to which the object is to be camouflaged from him.

The camouflage scheme for a camouflage pattern may be elaborated so as to employ vertical and/or horizontal property bands. This can be employed in particular as the so-called urban camouflage pattern in urban surroundings in which primarily perpendicular and horizontal and angled patterns will be present, determined by the shape of buildings, such as building edges, windows, or doors.

In another mode excellent camouflage properties are achieved by subdividing the camouflage pattern areas into pairs of approximately parallel property bands intersecting and superimposed at angles between above zero and beneath 90°.

In more specific embodiments the property bands may be displaced e.g. parallel to the diagonals or straight lines. In this way variants of camouflage pattern configurations are obtained.

It is further possible to randomly combine pairs of property bands with, or superimpose on, one another. Again this serves to further improve camouflage e.g. in the woodland pattern.

The borderlines between the pairs of property bands may in special cases be configured as contrasting lines, e.g. in an urban and woodland pattern and/or alternatingly as a fuzzy transition, e.g. in a plain, desert, urban, and woodland pattern. Once again this serves to improve camouflage.

The camouflage scheme according to the invention may preferably be intended to be transferred to or incorporated into previously existing camouflage patterns. Thus, existing patterns can continue to be used in their shape and color themes. The recognition effect and identification value e.g. of uniforms is thus retained.

According to a preferred specific embodiment the camouflage scheme is applicable to the entire spectrum of electromagnetic waves and allows application to objects emitting heat or other invisible radiation such as radio waves and UV radiation. This is because in these cases different background property zones such as the background temperature are recognizable. Thus for example rock, soft woods, water, metals, the sky etc. differ in their radiation and reflection characteristics.

The camouflage scheme or the camouflage pattern is advantageously configured such that it extends uninterruptedly, continuously on the surface of the object to be camouflaged, continuing for example around object edges or other angled surface areas. Different visual angles on the object to be camouflaged are thus immaterial. The pattern should not be interrupted for the fractal structure and subdividing into property bands and zones to take effect.

In a more specific embodiment fractal interweaving and thus a continuous camouflage effect is achieved over particularly highly different distances by means of intersecting, parallel property bands being subdivided into sub-zones. These sub-zones may in turn be subdivided into sub-sub-zones and so on.

According to a preferred specific embodiment the camouflage scheme configures camouflage patterns for surfaces to be processed further such as textile fabrics, camouflage net fabrics, tarpaulins, prefabricated components. The structures of the camouflage pattern such as parallel property bands, borderlines, zones and sub-zones are not interrupted in any place of the camouflage pattern scheme. In this way the superimposed camouflage scheme remains intact when cutting or processing the material.

According to another embodiment, a camouflage object is provided and includes a body having an area, and a camouflage pattern placed in the area of the body. The camouflage pattern is formed by: at least two first bands both extending in the same first running direction across the area and each having a first length, the at least two first bands each including a first perceptible characteristic extending along the entire first length of the at least two first bands, at least one second band extending in a second running direction across the area of the body of the camouflage object and having a second length, the at least one second band including a second perceptible characteristic extending along the entire second length of the at least one second band, the at least one second band at least partially overlapping the at least two first bands, and a plurality of zones formed by the intersection of the at least two first bands and the at least one second band, the plurality of zones each having a pattern formed by the combination of the first perceptible characteristic of the at least two first bands and the second perceptible characteristic of the at least one second band.

In a further embodiment, a camouflage object is provided and includes a body, a camouflage coating applied to a surface of the body, at least part of the coating formed with: at least two first bands both extending in the same first running direction and each having a first length, the at least two first bands each including a first perceptible characteristic extending along the entire first length of the at least two first bands, at least one second band extending in a second running direction and having a second length, the at least one second band including a second perceptible characteristic extending along the entire second length of the at least one second band, the at least one second band at least partially overlapping the at least two first bands, and a plurality of zones formed by the intersection of the at least two first bands and the at least one second band, the plurality of zones each having a pattern formed by the combination of the first perceptible characteristic of the at least two first bands and the second perceptible characteristic of the at least one second band.

Advantageously the concrete height and width of the repeat pattern for a camouflage suit is specified on the basis of standard values. To avoid interruptions, seams, pockets, fasteners etc. are avoided as far as possible.

BRIEF DESCRIPTION OF THE DRAWINGS

FIG. 30A is a schematic illustration showing a camouflage object of the present invention;

FIG. 30B is a schematic illustration of the object of FIG. 30A showing first bands extending in a first running direction across an area on the object;

FIG. 30C is a schematic illustration of the object of FIG. 30A showing second bands extending in a second running direction across the area on the object;

FIG. 30D is a schematic illustration showing a plurality of zones in the area of the object of FIG. 30A formed by the first bands of FIG. 30B overlapping the second bands of FIG. 30C;

FIG. 31A is a schematic illustration showing another embodiment of a camouflage object of the present invention;

FIG. 31B is a schematic illustration of the object of FIG. 31A showing first bands extending in a first running direction across an area on the object;

FIG. 31C is a schematic illustration of the object of FIG. 31A showing second bands extending in a second running direction across the area on the object;

FIG. 31D is a schematic illustration showing a plurality of zones in the area of the object of FIG. 31A formed by the first bands of FIG. 31B overlapping the second bands of FIG. 31C;

FIG. 32A is a schematic illustration showing a further embodiment of a camouflage object of the present invention;

FIG. 32B is a schematic illustration of the object of FIG. 32A showing first bands extending in a first running direction across an area on the object;

FIG. 32C is a schematic illustration of the object of FIG. 32A showing second bands extending in a second running direction across the area on the object;

FIG. 32D is a schematic illustration showing a plurality of zones in the area of the object of FIG. 32A formed by the first bands of FIG. 32B overlapping the second bands of FIG. 32C.

DETAILED DESCRIPTION

Figure 1:
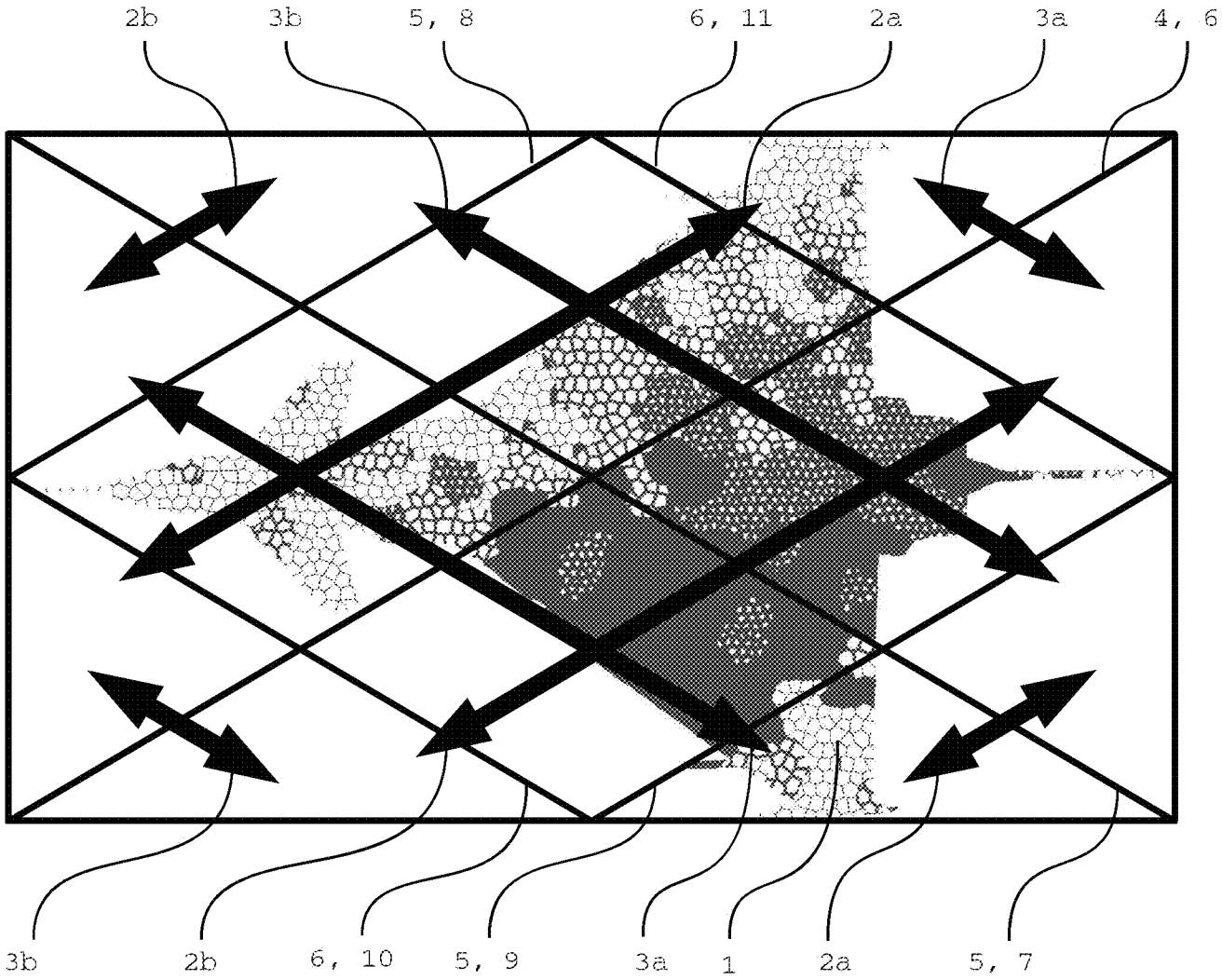
FIG. 1 is a schematic illustration of a camouflage pattern on aircraft, illustrating the bands and reference lines for explaining the scheme.
Figure 2:
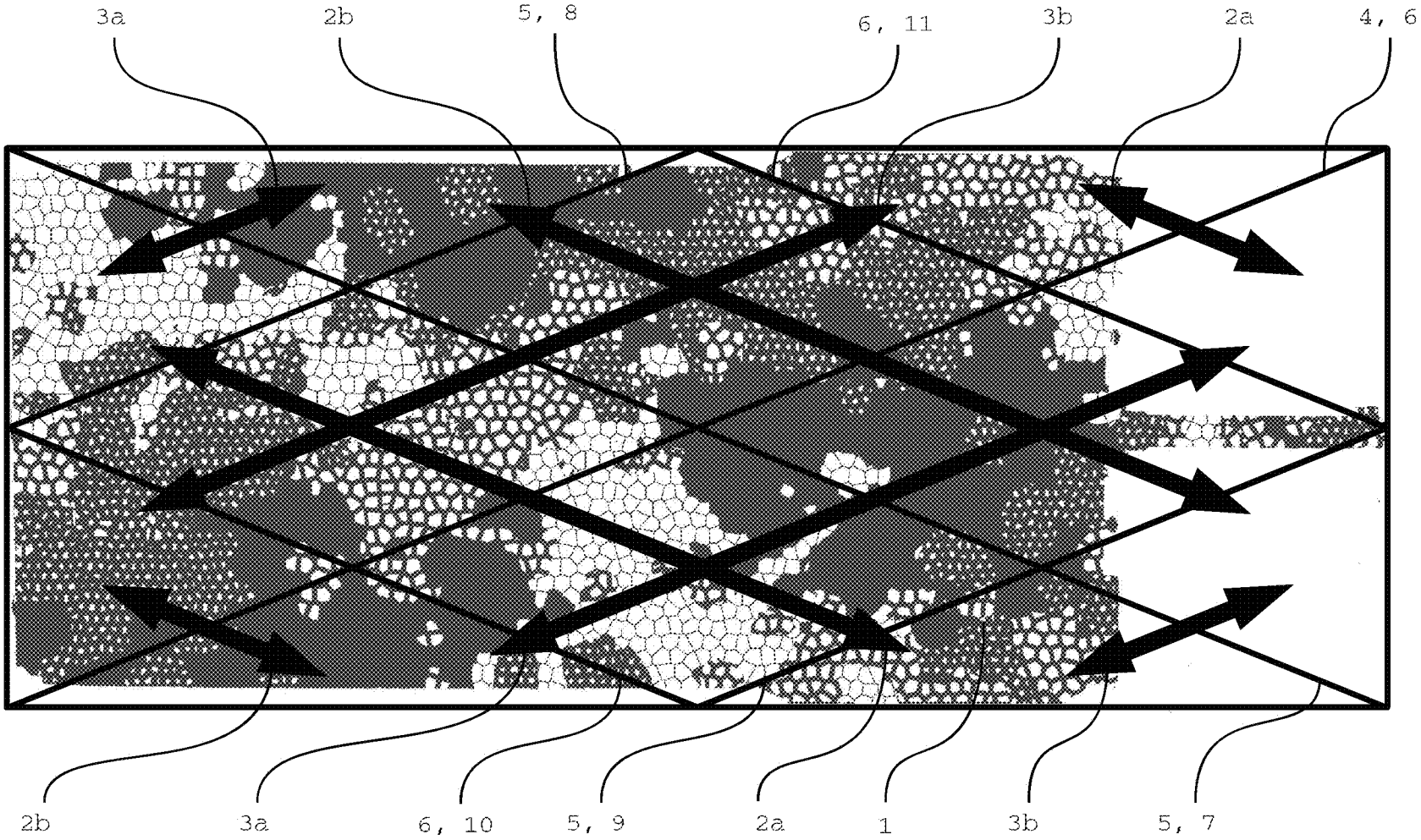
FIG. 2 is a schematic illustration of a camouflage pattern on a tank in a top view, illustrating the bands and reference lines for explaining the scheme.
Figure 3:
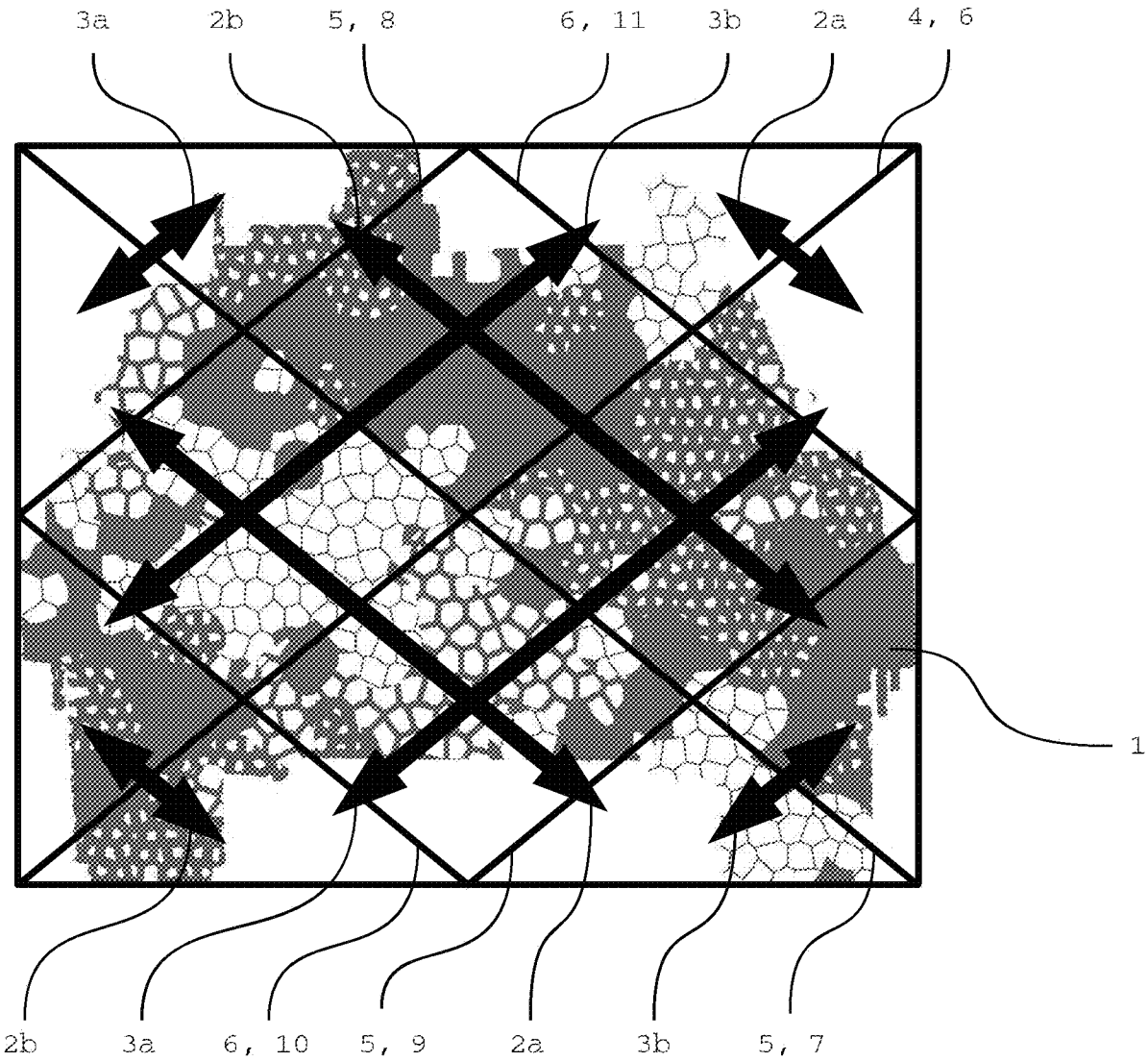
FIG. 3 is a schematic illustration of a camouflage pattern on a tank in a front view, illustrating the bands and reference lines for explaining the scheme.
Figure 4:
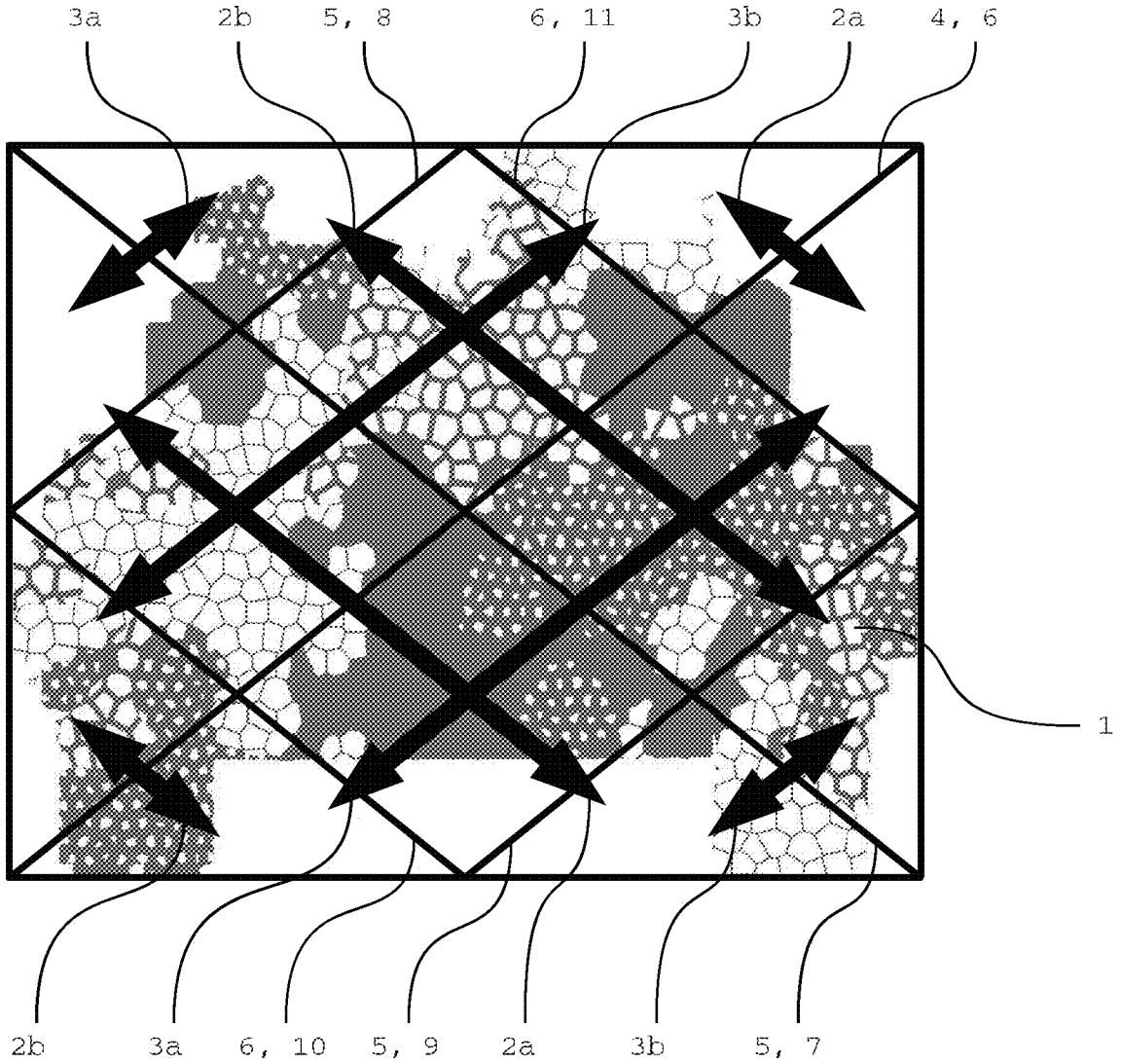
FIG. 4 is a schematic illustration of a camouflage pattern on a tank in a rear view, illustrating the bands and reference lines for explaining the scheme.
Figure 5:
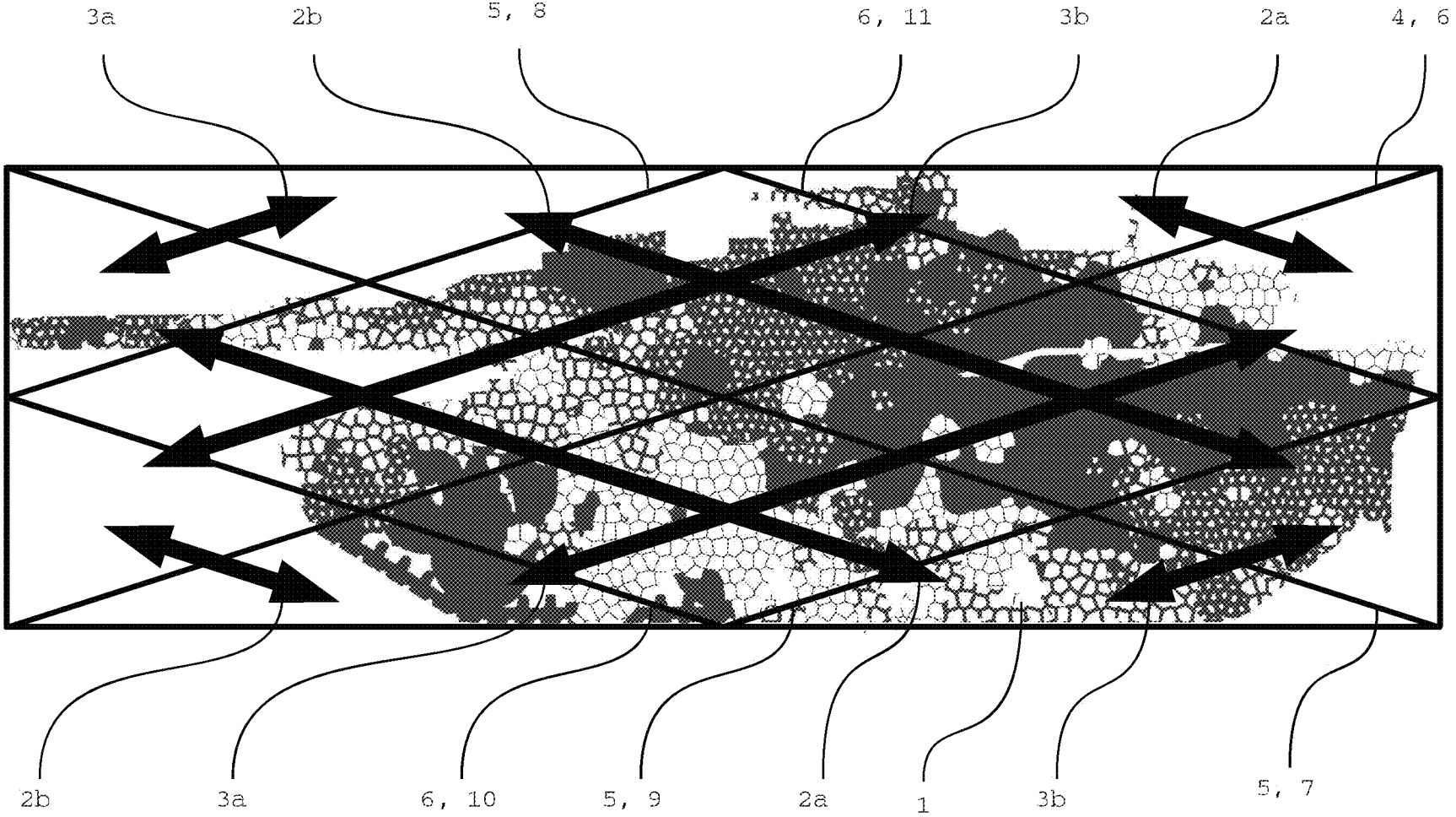
FIG. 5 is a schematic illustration of a camouflage pattern on a tank in a side view from the left, illustrating the bands and reference lines for explaining the scheme.
Figure 6:
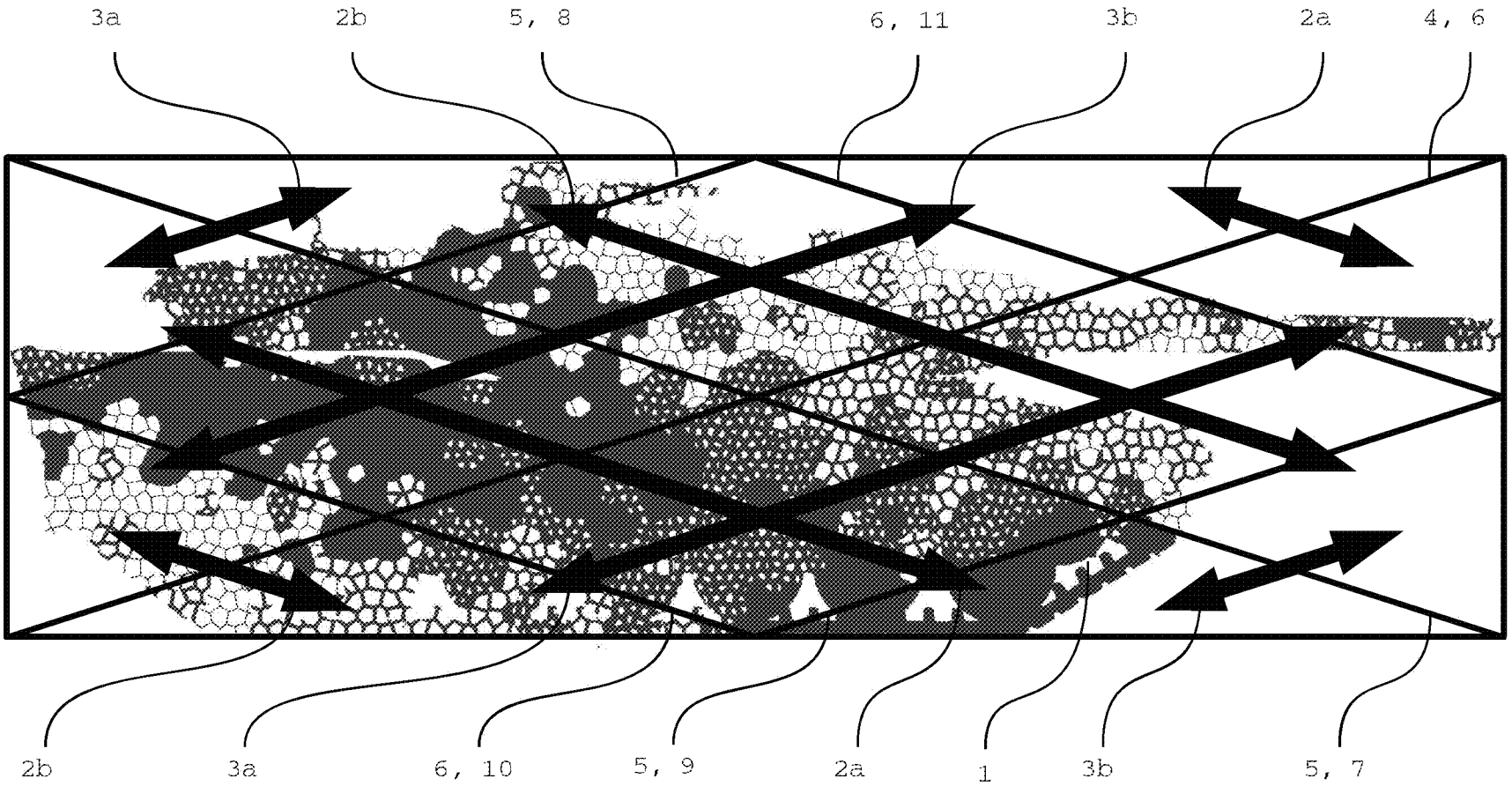
FIG. 6 is a schematic illustration of a camouflage pattern on a tank in a side view from the right, illustrating the bands and reference lines for explaining the scheme.
Figure 7:
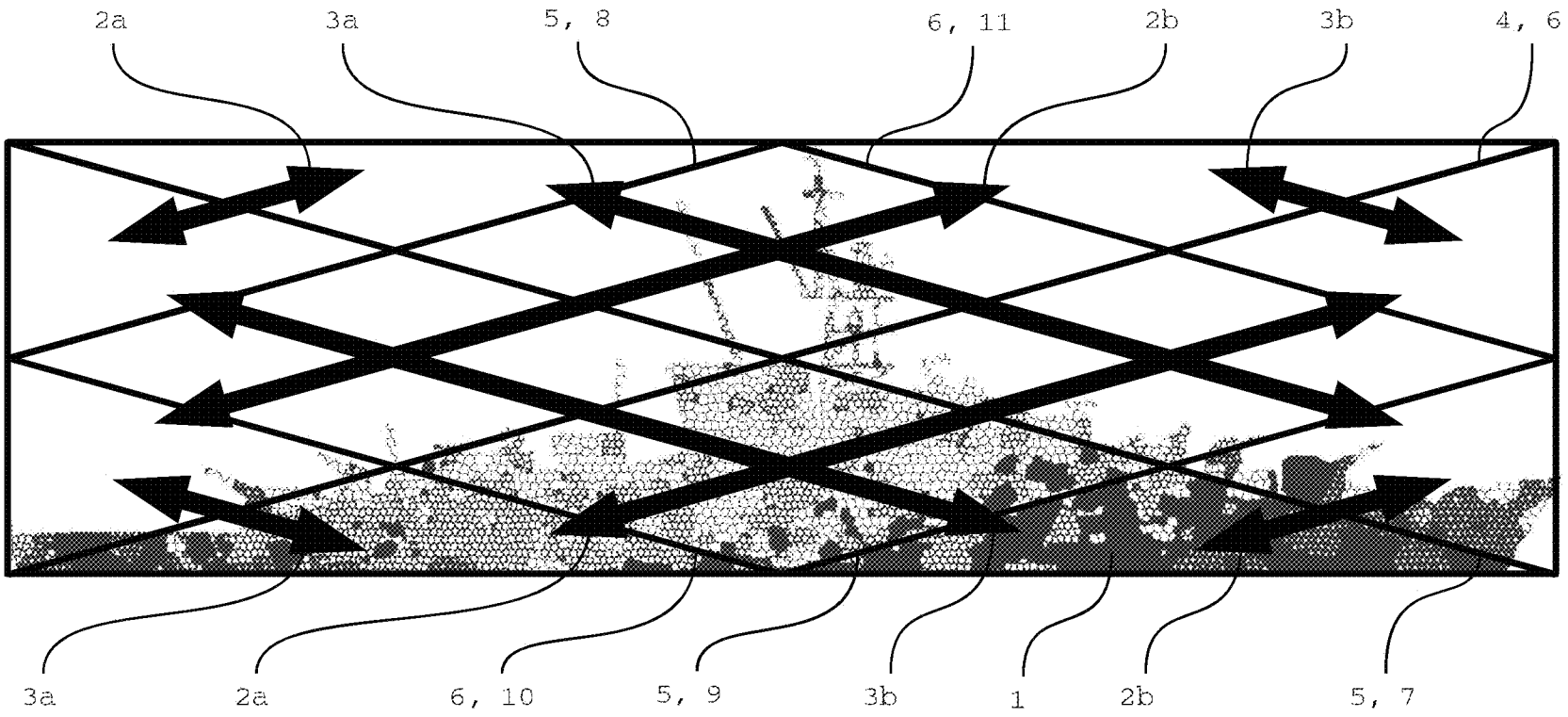
FIG. 7 is a schematic illustration of a camouflage pattern on a ship in a side view, illustrating the bands and reference lines for explaining the scheme.

Objects are either not visible; when they blend into the background (=camouflage) there is no distinction between the object and the background, or they are always visible against a background. The terms "positive" and "negative space" which O'Neill et al. use in the U.S. Pat. No. 6,805,957 are dubious since they are random definitions but not natural conditions. For example, while one may in fact have the impression from a distance of 100 m that the space between two trees (="positive space in the sense of the above definition") is empty (="negative"), from a distance of e.g. 30 m the same space tends to be filled with slim trunks, branches, leaves, etc., which would again be a "positive space" in the above sense. Thus, every object of the body's background e.g. a tree can always be broken down, in relation to the distance of the observer, into an infinite number of sub-objects (from far to near: dark spot, then tree, then foliage, then leaves and branches, then bark, leaf veins, leaf stems, etc.). However, the claim of the camouflage system according to the invention is not limited to one distance but to the contrary it can be continuously employed at any distance. The terms of "positive and negative space" thus do not appear consistent nor logical per se, they are thus at best partially applicable. It appears more conclusive in terms of logic to describe the background properties viewed as an area.

For one since no other option is possible of illustrating on a surface, thus two-dimensional, e.g. a clothing suit which is anyway always an area enveloping a body, or e.g. a vehicle as an object to be camouflaged. This also applies to "ghillie suits". These are special camouflage suits primarily used by snipers, consisting of camouflage nets with additional materials inserted, such as burlap or twigs. All of these are perceptible as an object from short distances at ca. 20 m to 30 m, although with a structured surface. This is the very characteristic of camouflage, to image on a surface something other than is actually present in the object. This means in other words that the object does not consist of the same materials and structures as the background. Camouflage of a surface would then be substantially superfluous. What is significant is configuring the surface so as to make the object appear as does the background, whether or not it consists of the same materials as the background. Examples from wildlife of camouflage similar to a "ghillie suit" include e.g. some crabs growing algae on their bodies, or flies which build tubes from pebbles in their surroundings.

For another because a projection on the human retina is always a two-dimensional image which the brain ultimately computes into a three-dimensional image due to two-eyed vision. This is where a wide range of optic illusions are possible. Even if stereoscopic vision is not given when looking through a sighting telescope or in imaging on the screen of a thermal image converter/night vision device etc. due to absence of direct binocular vision of object and background (usually one looks through a sighting telescope with one eye, and a screen is again a plane).

In summary, with signals captured as visible light, infra red, UV etc. in a processing chain (eye/brain, image processing/optical aids), one two-dimensional image per eye will ultimately primarily always be generated from which the brain forms a three-dimensional image, for evaluation. What is decisive is that it is irrelevant whether the captured signals originate from a three-dimensional object or a two-dimensional, patterned object or a structured surface: A two-dimensional image will be created.

Viewed in this way, the subject (=observer) will perceive both the object and the background as areas. This requires pick-up and description of the object and background as areas. What is conspicuous is thus differences between the object and background imaged through the electromagnetic spectrum in the signature features substantial for signal pick-up, below called pick-up features for short. Features such as smell, taste, noise, will presently be disregarded.

The optical pick-up features will be described below using the background as an example. For camouflage the communication between object and receiver must be interfered with and the perceptible features, in this case the surface of the object to be camouflaged, must be such that they are identical with that of the background in as many of these features as possible, masking the character of the object.

The background, viewed as an area, can be described by the pick-up features indicated below. These can be understood as a mode between two poles of extremes. The most extreme cases are: a signal is incident on the receiver, and no signal is incident on the receiver. The feature modes tend to be present in fuzzy transitions. What has just been described is elementary for the effect described below. Examples of these features occurring in nature are indicated in brackets:

1. Light-dark (shadow, light, counterlight),
2. Color spectrum (e.g. from brown to green, for example camouflage suit for verdant terrain). This area designation is simplified to more clearly characterize the extreme poles. For this application, shades of brown include e.g. gray, yellow, and red hues. It will be understood that other backgrounds such as cold deserts or hot deserts have other extreme color poles, 3. Patterns; even if ultimately every image can be mathematically composed of dots, human, macroscopic view makes this distinction: line-spot,
4. Contrast; contrasts or transitions may exist between the color areas,
5. Saturated (lush leaves, wet foliage) and unsaturated (dry branches, dry foliage) colors,
6. Warm colors (though very subjective), e.g. autumn leaves-cold colors such as fresh leaves,
7. Glossy colors, e.g. wet leaves-dull colors, e.g. dry tree bark,
8. Invisible radiation (e.g. UV, heat, infra red, radio waves).

The significance determined by the practical relevance for the application decreases with ascending number. Item 8 is an exception thereof since it gains increasing significance in present-day fighting fields. The first five items are substantial, the first two items are essential for practical application in the field of camouflage clothing: Light-dark and colors can be perceived from longer distances than can structures. Item six is very subjective and difficult in application to be relevant in practice. Item seven may include specific applications e.g. at sea, reflections of the sea surface.

For all of the items it is important that the smallest possible range of camouflage means, in the present example printed colors, must cover the entire conceivable background property space. This is significant not only to minimize costs but primarily because the separation efficiency of perception is intended to be deceived by the 50% rule. Applying this 50% rule, approximately 50% of the area to be camouflaged are configured in each of the background properties in the most extreme possible mode of one of the poles of a background property but not as was usual to date, a medium color of the property and approximately 50% in the diametrically exactly contrary property mode. For a suit for verdant terrain this means a distribution 50% light-50% dark, 50% brown-50% green, 50% lines-50% spots. Care should be taken for these zones to not be congruent such as light=brown or dark=green, but again that 50% of the light area be brown and 50% green, and likewise regarding the dark and line/spot structures. Using the smallest possible number of properties is important because, when for example too many similar brown hues are used over the others, one of which is, however better matched to the background property, the latter will be conspicuous (=relativity of conspicuousness).

The object or the item visible against the background, in other words the object to be camouflaged, can be classified in respect of its mobility in 1. Objects stationary in location and posture and shape such as hunter's hides, bunkers, etc.
2. Objects non-stationary in location (=mobile) though fixed in posture and shape, e.g. ships, vehicles, where e.g. the top surface is always on top and the bottom, always at the bottom.
3. Objects non-stationary in location and posture and shape such as humans, animals, mobile/deformable items such as parachutes.

The objects indicated under 1. can basically be perfectly matched to the specific backgrounds at the time in all the characteristics and from any viewing angle, the shape/structure/the material can be matched as well among other things by structural measures (e.g. planting).

In the case of mobile objects (2. and 3.) the shape/structure/material is derived from its function (e.g. stealth bombers, swiveling tank turret and its washability of ABC matter, hunter's bow and arrow) and most of these cannot be camouflaged in shape/structure/material without loss of function and restriction of movement. This will be exemplarily clear in particular with camouflage clothing as distinguished from so-called ghillie suits which, although largely allowing structural adaptation to the surroundings, are adapted involving restriction of movement, increased weight, and increased noise level, and often restricted vision and hearing.

A camouflage pattern, however, allows 100% mobility, is cheap and comparatively simple in manufacture compared to more complicated methods such as e.g. "ghillie suits", incorporating radiation sources, e.g. LEDs, nano-technology, attaching water nozzles to create water curtains for ships, to match the emission of the object to that of the background.

Moreover, and this is essential, mobile objects are positioned against constantly changing backgrounds. These changes are related among other things to the time of day and the season, the angle of observation, e.g. from above, from the side or the bottom, to the distance of the observer (changes in the proportions and structures, e.g. a tree looks like a green area from 100 m distance, from 20 m distance one recognizes gray branches, dark shadows and green foliage in this green area etc., local zones next to one another in the visual field of an observer, and changes in the surroundings (woodside, softwoods, hardwoods, sandy/verdant ground, grass, in front of/next to a tree). These changes, which is again essential, do not only occur between different "tactical surroundings" (e.g. "woodland", "urban", "desert"), as is often generally suggested, but to a high degree within these. It may happen that in some places e.g. dried grass, river banks etc. in temperate zones desert-like color spaces occur with lush green grass being immediately adjacent thereto.

Furthermore, it is not acceptable to assume axes of symmetry. In the case of objects movable in themselves, e.g. humans, a person will hardly ever take a symmetric posture. When regarding a human as a two-dimensional area against a two-dimensional background area, there will in most cases be an asymmetric, two-dimensional illustrative area in movement/dynamic. The same holds in most cases for objects not movable in themselves (e.g. vehicles, ships) which appear as an asymmetric area due to the viewing angle. Humans are still symmetric in their macroscopic anatomy although in the image that the observer knows, not in the posture/situation he can specifically see at the time.

Any object will be 100% invisible only if it is 100% identical with the optical pick-up features of the background. This will function only in the case of a constantly changing adaptation and if the object itself had no bulk. Since due to the permanent configuration of surface finishes this is not feasible in practice but it may be, due to automatic emission of radiation or active camouflage techniques, the scope of passive camouflage techniques has thus far only offered the way of color mixture which, however, shows the drawbacks indicated above.

The invention takes a different approach:

Based on the above statements it is logical that the observer will at any rate only have a purely optical perception of the object (subconscious process). The only question is how much he sees, how he sees, and whether this is sufficient for drawing his attention (developing awareness) towards the object. This is because proper recognition first requires purely optical perception, then selective and concentrated attention, and then evaluation/decision. The purely optical being seen (optical signals are incident on the retina) per se is not a problem for the object.

Attention will be particularly drawn as:

a large area is seen, a regularly shaped area appears (primarily parallelograms e.g. pants legs), clearly recognizable areas move, in particular fast.

Another condition is essential as well: the relativity of conspicuousness.

Against a defined background area in specified modes having the properties indicated above, of two same-size and same-shape areas adjacent to one another that one will be more conspicuous against said background area that deviates in its background properties more than the other from the shared background area. Attention will always first be drawn to the more conspicuous area. The other area will recede in relative attention.

Figure 18:
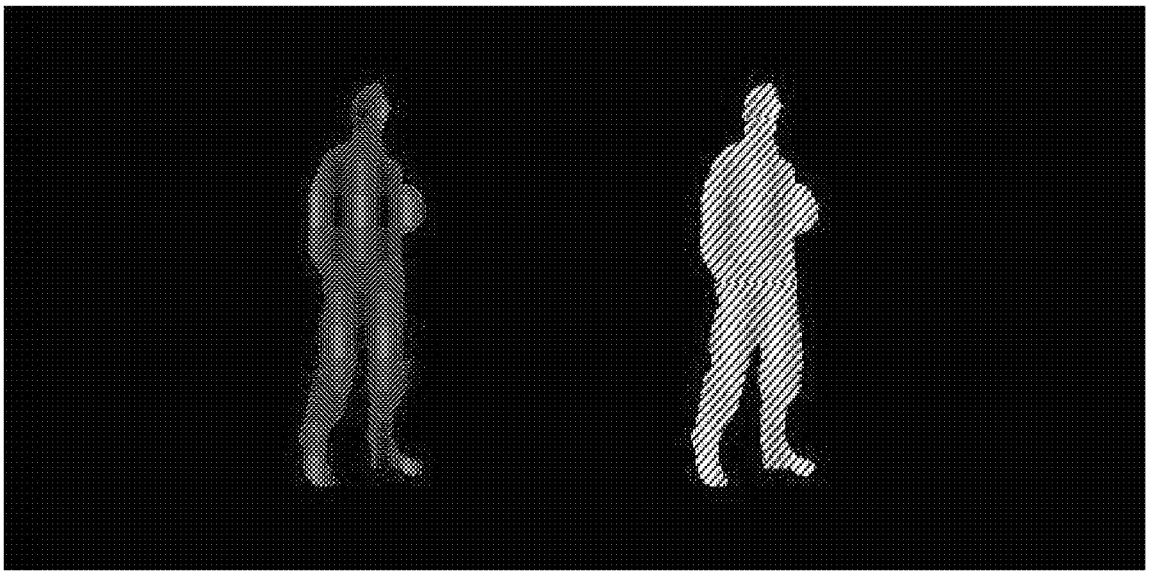
FIG. 18 is a schematic illustration of one exemplary dark gray body and one lighter gray body against a black background showing different perceptions.
Figure 19:
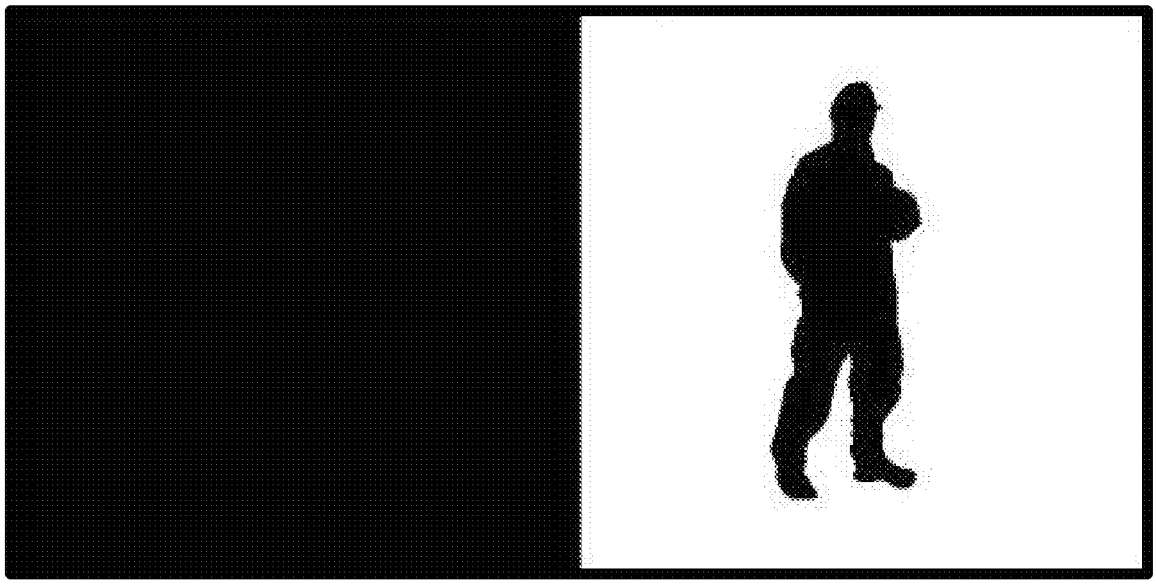
FIG. 19 is a schematic illustration of an object in specialized camouflage, entirely invisible against one background and entirely visible against another background.

What is decisive is the relative difference. The effect will occur for example when one places against a black area a light gray (more conspicuous) and a dark gray (less conspicuous) area, see FIG. 18. However, the same happens in analogy with gradual color shades: For example, when one places against a monochrome blue-violet-green area, a monochrome blue-turquoise-green (less conspicuous) area and a monochrome yellow-green (more conspicuous) area. Thus the decisive factor is not to perfectly emulate the background properties in the area placed in the foreground but it is which of two areas placed against the background for comparison shows more similarity with the background. In other words, one cannot only make an area disappear by designing it as inconspicuously as possible but also by placing a more conspicuous one next to it. This is the effect that the present invention utilizes.

The camouflage pattern area 1 is configured such that in each of the background properties (see above) approximately 50% of the area to be camouflaged are configured in the most extreme mode possible of the background property and approximately 50% in the diametrically exactly contrary mode. For example, for a suit for verdant terrain: 50% light-50% dark, 50% brown-50% green. What is provided is, a light property band 2*a* and a dark property band 2*b*, a brown property band 3*a*, and a green property band 3*b*. Care should be taken for these property bands 2*a*, 2*b*, 3*a*, 3*b* to not be congruent such as light=brown or dark=green, but again that 50% of the light area be brown and 50% green, and in analogy regarding the dark and line/spot structures. This will be achieved by superimposing the property bands 2*a*, 2*b*, 3*a*, 3*b* in such a way that intersections, so-called zones, will appear.

Furthermore, the brown and green property bands 3*a* and 3*b* extend in parallel as irregular color bands. The light and dark property bands 2*a* and 2*b* again extend as parallel, irregular property bands 2*a* and 2*b* although angled relative to brown/green such that these four property bands 2*a*, 2*b* and 3*a*, 3*b* intersect and superimpose one another so as to make up light green, light brown, dark green, and dark brown spots, the so-called zones. In the exemplary embodiment the borderline is formed as spots at one of the borderlines between brown and green. The next of the borderlines between brown and green will then be formed by lines. The borderline "contrast" extends along one of the borderlines between light and dark. The borderline "transition" extends along the other of the borderlines between light and dark. The property bands 2*a*, 2*b*, 3*a*, 3*b* are furthermore defined irregularly so as to impede the observing of movement.

What is particularly conspicuous are elongated parallelograms (primarily extremities) which with the described method are consequently subdivided into smaller areas with no spatial direction (quadrangles, or better a disk as an extreme sample of absent spatial guidance for the eye, compared e.g. to a rectangle which will have a direction in space when "lying"). The pattern areas indicated above should be distributed such that a body is no longer recognizable as such in any position or pose.

The principle of the property bands 2*a*, 2*b*, 3*a*, 3*b* begins in the large pattern areas (e.g. "light/dark") and continues down to the smallest pattern areas in the sense of a fractal (e.g. separately illustrated branches/leaves). Furthermore, due to the interweaving to obtain a fractal pattern relative to the zone size, blending into the background is possible at any distance. For example, at long distances some green bushes may appear as dark spots on the horizon. At short distances one will recognize shadows and foliage. At close distance, leaves and branches. The pattern reflects this.

Furthermore, due to this approach the technique of the surface treatment specification is self-defined in analogy to a mathematical equation. It quasi grows along with the size of the object to be camouflaged. It can thus be applied to bags and camouflage clothing as well as to tanks, aircraft, and ships.

The object to be camouflaged is not treated on the basis of axes of symmetry but based on the substantial object areas of the essential portions of the object. These are the large, geometric base areas of which the object area is composed when viewed from a visual angle. The large object areas, using the human body shape as an example, are formed by the head, torso, and the four extremities. In the case of a tank these are e.g. in a side view, the body trough with the chassis, the side view of the turret, and the barrel. Due to the unstable shapes of objects movable in themselves, e.g. humans, axes of symmetry can be determined based on anatomy though not in the actually assumed posture which tends to be an asymmetric area and moreover changes from one moment to the next.

This is why the areas of an object to be camouflaged are reduced to those areas that are substantially movable relative to one another though stationary (relative to their position in the entire object; object areas). In the case of humans this means for example the arms, legs, torso, and head but not e.g. the foot or lower leg relative to the thigh. In the case of a tank, however, only the turret and the barrel are movable relative to the trough and the chassis. This is why in a lateral view it consists of only three areas movable relative to one another though stationary: barrel, turret, chassis with trough. Ships substantially have one lateral surface only, as does aircraft. Still, the fractal pattern structure results in a further subdivision of the individual, smaller object parts. For example, a gun turret located in the dark field of a ship's camouflage will again be subdivided into single areas and treated by the 50% rule as described above, thus it will be broken down not only against the background of the sea/the sky but against the entire ship as well. On the whole it will remain dark though and thus associated with the superimposed dark field.

The extent to which this fractal approach is elaborated, depends on the intended possible nearness to an observer up to which the object is to be camouflaged from him.

The size of the repeat pattern will depend on the object to be camouflaged. This can best be achieved by way of approximately applying the 50% rule described above to each of these areas, e.g. 50% of the leg light brown, 50% dark brown and 50% light green and 50% dark green, such that large zones of contrasting background properties occur in the object. Thus far, suits have always had small-portion patterns such that a large number of spots of the same property are present in each of the specified separate areas of the body. This is why the following will happen against a dark background: The light spots will become visible, the dark ones recede in comparison. A conventional suit is e.g. provided with visible light brown spots on the entire leg spaced apart e.g. 5 cm each. Thus the leg will be quasi highlighted like a warning signal against the dark background as a leg in its entirety, since many similar optical stimuli occur in regular distances so as to produce a contour line, since in this way the visual stimulus triggers will be observed as one unit, in particular with movement in synchrony.

With the present invention, however, for example only the lower leg will be perceived as light while the thigh will recede. The entire leg is not recognizable as a leg but only a light spot is (lower leg). Since light spots will always also appear in dark areas, this might as well be e.g. a sunlit tree stump. Since this will not be associated with a human body but will be perceived as a natural occurrence and thus not menacing, it will not be actively observed. Another example is a "brown branch" in front of a "green bush" or "green plants" on "brown forest soil". In contrast thereto, an olive (being a blend of brown and green as it appears in conventional suits) leg would be as conspicuous against a green bush as against brown leafy soil.

What is furthermore important is the proportions of the areas and the spatial arrangement of the areas.

The spatial arrangement must match the structure of the surroundings. Furthermore, it must be inconspicuous against the background in each position/posture (standing, lying, squatting, lying prone/on the back) and from every visual angle. The repeat pattern must furthermore be ensured. Also, the area for printing should be subdivided into the largest possible sub-areas.

In verdant surroundings for example implementing these specifications has proven optimal by way of a layout inclined approximately 45 degrees e.g. relative to the human longitudinal body axis. Regardless of how the suit is cut and what position (posture, standing, lying) the wearer takes, the zone lines will blend into the surroundings and their perspective distortion. In urban surroundings, however, partial lines parallel to the principal body axis have been incorporated. Right angles are avoided, however, to create a spatial-perspective impression and because they hardly occur in nature and in urban regions when their image is regarded in perspective as a plane, and would thus draw the attention of an observer. In primarily horizontally structured surroundings (desert/sea) the described automatic blending of the pattern into the object results in an appropriate formation until it masks e.g. the side view of the ship.

Furthermore, the property band borders are designed in a line approximately 50% as transition and 50% as contrast since both contrasts and transitions occur in nature. Existing suits have thus far, at a specified distance from the observer, imaged either contrasts only (e.g. WWII Splintertarn, US "woodland", Predator™) or transition (BW Flecktarn, MARPAT, CADPAT, ARPAT).

The pattern proper, i.e. whether it images leaves, grasses or spots, or abstract shapes such as pixels, is of secondary significance. These structures can be recognized in precise detail only at very close distances. In this range even e.g. buttons are recognizable which are therefore consistently avoided in applying the invention to camouflage clothing as presently set forth exemplarily for applying patterns. What is significant is, however, the spatial proportions of the areas. They must match the background in rhythm, with a fractal adaptation to lengthening/shortening distances. This is not present for example in the woodland suit or splinter suit or BW-Flecktarn. The subdivision of the pattern areas into lines and point-shaped color spots is to be understood in this sense.

Another advantage of this virtual independence of a pattern is the fact that it can be incorporated into existing camouflage patterns which can thus be significantly improved. This is important for example for maintaining "corporate identity" e.g. of an army by their uniforms, and likewise of police, recreational teams, etc. In fashion applications such as patterns from script, Scottish plaids, this approach is again conceivable. Furthermore, costs can be saved. Incorporating is understood to mean that the theme of shapes of the existing pattern is adopted and it will only be rearranged according to the principles indicated in the invention.

The pattern theme is significant, e.g. leaves or pebbles, if absolute perfection in camouflage is desired at ultra-close distances less than ca. 10 m and/or specialization, e.g. urban suit for counterterrorism units. For a suit intended for largely verdant terrain (jungle, temperate zones, e.g. central Europe) having eight background poles (light-dark, brown-green, spot-line, contrast-transition) at least four colors are thus required (light/dark brown and light/dark green) to ensure such a structure. A specific exemplary embodiment includes eight colors since this allows to elaborate starker contrasts between the colors and thus better structures along with better matched transitions. These eight colors have been elaborated in years of work from the naturally occurring colors worldwide and have been found to be a well-balanced mix (neither too many nor too few):

Light: palest green, sand
medium: green medium, autumn-leaf orange
medium dark: bark gray,
dark: green dark,
very dark: brown dark
darkest: black For suits for largely barren terrain (snow/hot/water/sky "deserts") employing more scintillating effects has been found more useful, i.e. more smaller areas with borders made fuzzy by scintillation, i.e. less sharp transitions between the large areas composed of the small spots, than in verdant terrain. This means that the suit is specifically manufactured for vegetation zones, meaning e.g. for central Europe or for deserts or jungle or alpine or polar regions. This means that repeated changing of clothes is dispensed with as it has been required with hunting clothes thus far e.g. in changing from brown to green or oak to conifer forest. On the other hand the suit will, unlike existing suits, cover these vegetation zones more completely. This means that the camouflage effect achieved will be better in different seasons and against different background sub-areas (brown, green, light, dark, leaves, bark, trunk, pebbles, grass, sand) occurring in a vegetation zone e.g. in central Europe.

The following further colors are considered to be incorporated into the above canon of eight colors for adaptation to other color spaces. What is important is that this is an intermatched, modular color system for the family of camouflage patterns with their illustrated proportions as set forth presently as an example of an application of the invention. This is why these colors can be exchanged for one another. What is also conceivable is expanding the color space to meet specific requirements or developing other color spaces, as long as the described principle of pattern development is maintained. The color space developed thus far is:

Lightest: snow white,
very light: autumn yellow, urban white,
light: desert pink, sand, green lightest, snow gray, medium light: grass yellow, urban gray,
medium: green medium, autumn-leaf orange, brick red urban brown,
medium dark: bark gray, autumn red
dark: green dark,
very dark: brown dark, asphalt gray,
darkest: black.

Preferred applications provide for absence of fuzzy color transitions in favor of full strength colors since stark contrasts of adjacent, different-size spots result in a "scintillating effect" similar to a zebra pattern. This makes it more difficult to capture borders and posture of individual object parts relative to one another. This prohibits a correct assessment of distances from an object, of movement, direction of movement, bulk, posture, position, and recognizing e.g. the type of vehicle, in analogy to "dazzle painting" employed in the first and second world wars primarily on warships.

Various specialized applications are conceivable for specific tactical backgrounds or else for hunting. For example for hunting in winter grassland/reed: stark contrast borders are absent, the structure almost solely consists of lines with hardly any spots. The color space is limited to brown-gray-yellow hues.

The principles indicated above are likewise applicable to infrared, near-infrared, radio wave, UV, and thermal ranges, since the backgrounds e.g. rocks next to trees are once again variable in their radiation response, creating zones.

The concrete application of the present invention leads to the design of a new cut for camouflage suits to optimally present the pattern while being highly ergonomic. Ergonomics in the sense of facilitating movement is essential for surviving against the background of acting under high physical and psychic stress. It is therefore necessary to use the largest possible uninterrupted pattern areas with the fewest possible breaks e.g. by seams, sew-on badges, pockets, zippers, buttons, or protectors. For this reason the pants legs and sleeves, and the back are made from one piece only and with inside zippered pockets, no pocket flaps, and with the seams underarm and on the inside of the legs.

Cutting patterns have thus far cut up designs, see U.S. Pat. No. 6,805,957. The suits in use thus far have been cut up by way of fabric areas combined from many fabric pieces with outside pockets, pocket flaps, etc. Also there are often belt carriers, carrier vests, splinter protection vests, protectors, ABC-bags, ammunition bags etc., worn over the suit. These tend to be colored differently such as olive and/or black, which attenuates or cancels out the camouflage effect of the suit (e.g. black vest over desert camouflage suit) or printing is attempted. Although the latter is better than black or olive, the problem of a small-area pattern remains unsolved and added efforts and costs are involved.

Figure 10:
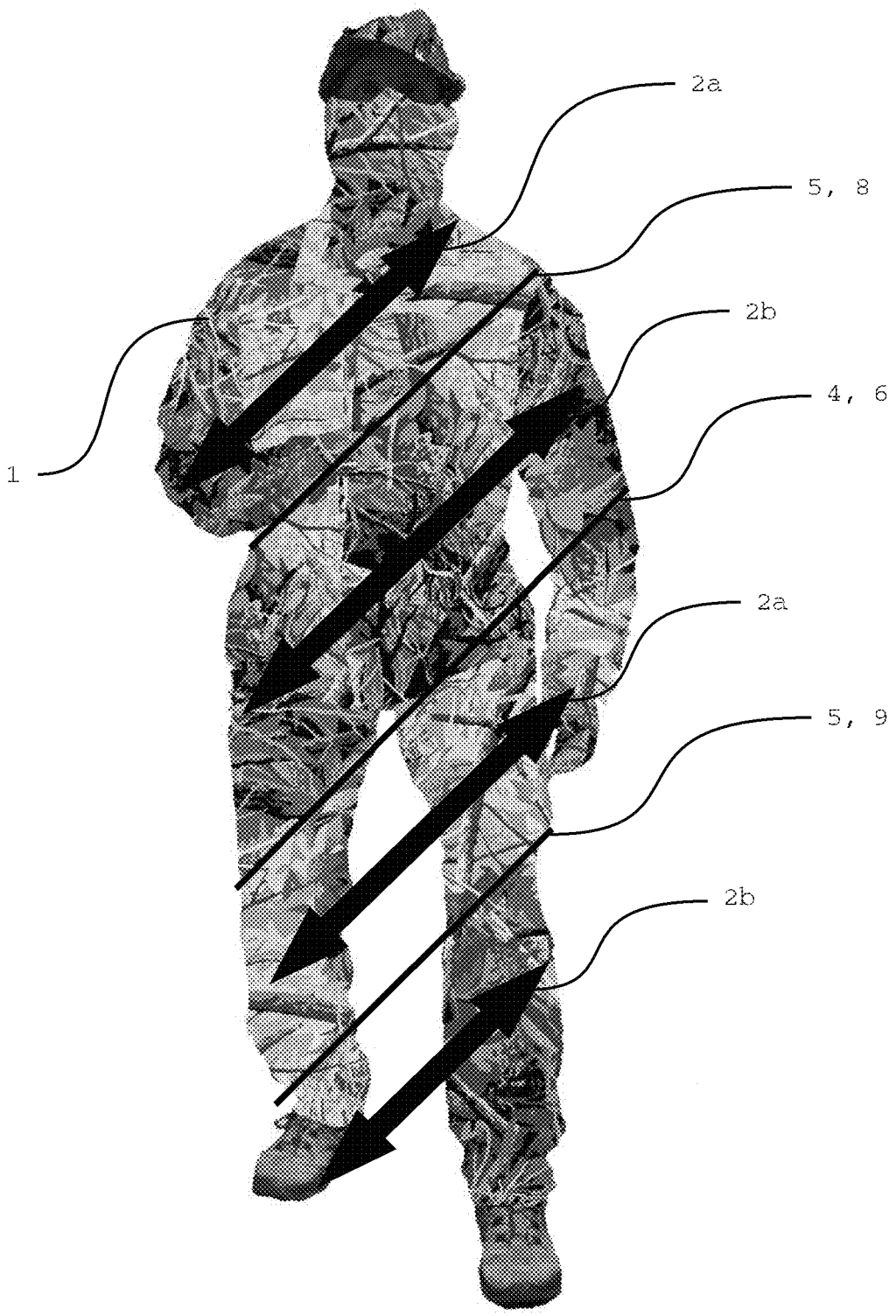
FIG. 10 is a schematic illustration of a camouflage pattern composition on camouflage clothing in a front view, illustrating only the light/dark bands for explaining the scheme with the cap, jacket and pants forming their own camouflage patterns.

It is thus the primary objective of the invention to create the largest possible continuous fabric areas. This is achieved by avoiding seams as far as possible (pants legs, coat sleeves, and coat front/back are all one-piece). There are only concealed pockets constructed with zippers. Pocket flaps are not used. There are no buttons or protectors disrupting the pattern on the outside. The pattern is thus just minimally disrupted. For practical application, a camouflage pattern area size is illustrated having a repeat pattern of the basic scheme between approximately 0.6 m and 1.0 m in width and between approximately 0.8 m and 1.3 m in length, as illustrated in FIG. 10.

A configuration as an integral suit provides transporting capacity for belt carriers, ABC protection, splinter protection, ammunition, water, and communication (radio etc.) and personal items. Thus there is no requirement for extra transporting vests, belt carriers, and ammunition/ABC bags. The splinter/ballistics/stabbing protection vest is worn beneath the camouflage suit; underneath that, water/wind protection, underneath, cold insulation as required, and underwear underneath. In this way a modular composition of clothing related to the application is achieved. In this way freedom/efficiency of movement is enhanced. Less clothing reduces weight. Some pockets, for safely carrying documents, are watertight. Knee and elbow protectors are attached inside or on the coat/pants so as to not disrupt the pattern.

The coat/pants and thus camouflage can be selected by the intended application. No summer/winter coats/pants are required since adaptation to weather occurs by way of the layers underneath. Thus the coat/pants are "only" required for optical, physical (thorns, tear, wear, abrasion to elbows/knees) and transportation functions, optionally electronics and possibly BNIC (biological, nuclear, incendiary, chemical) protection. It is highly breathable, quick-drying, and dirt-repelling. The colors of the camouflage suit do not change when wet or dirty.

Another advantage is that through pockets and oversuits are dispensed with. All of the equipment items are fast, easy, silent, single-handed, and accessible from the outside. Furthermore, the risk of getting caught on obstacles (branches, wire barriers, in parachuting, etc.) and the associated risk of detection (bush moving along, noise) and damage to equipment/the suit (buttons lost, pockets slit open, etc.) is reduced. Employing zippers furthermore allows loss-proof transportation of equipment.

The use of elastic materials and partitions in the pockets prevents the rattling of parts lying loose in the pockets and allows easy, quick, and organized access. The suit allows the attachment of camouflage materials to camouflage holders which do not disrupt the pattern, in anatomically functional places. This allows optimized camouflage. By means of precise, strategic placing of holders in anatomic key positions (head, shoulders, upper arms, back, sides and rear of thighs, rear of lower legs) there is no impediment as in ghillie suits to freedom of movement, vision, and noise camouflage. Furthermore, camouflage material can be saved and weight thus be reduced.

The scheme area 1 is configured as a quadrangle with the quadrangle side lengths corresponding to the maximal height or maximal width of the object to be camouflaged and/or the area to be camouflaged, said quadrangle serving as an aid in configuring the camouflage pattern area according to the invention. To this end a diagonal 4 or 7 is used through the quadrangle midpoint and two straight lines 8 and 9, or 10 and 11 extending in parallel through the side length midpoints. Thus the diagonal 4 or 7 and the straight lines 8 and 9 or 10 and 11 form pairs of parallel property bands 2*a* and 2*b* or 3*a* and 3*b*. These parallel property bands 2*a*, 2*b* or 3*a*, 3*b* may also be displaced parallel to the diagonal 4 or 7. These property bands 2*a*, 2*b* or 3*a*, 3*b* differ in one property mode wherein the property is expressed alternatingly in pairs of different degrees of lightness, color, saturation, pattern, structure or gloss. The diagonal 4 or 7 and the straight lines 8 and 9 or 10 and 11 form borderlines. Said borderlines of the property bands 2*a*, 2*b*, 3*a*, 3*b* may be configured continuously or discontinuously, high in contrast, or as fuzzy transitions. The borderlines between the pairs of property bands 2*a*, 2*b*, 3*a* and 3*b* may thus be configured alternatingly as a contrasting line 5 and/or as a fuzzy transition 6. The property bands 2*a*, 2*b*, 3*a*, 3*b* are defined irregularly or regularly. However, each property band 2*a*, 2*b*, 3*a*, 3*b* is in itself homogenous in one property mode. In this way one property of the camouflage pattern area 1 is present 40 to 60%, preferably 50% each in one mode and 40 to 60%, preferably 50% each, in another mode.

In another embodiment the scheme area 1 is configured as a quadrangle as in the preceding example. As a specific feature a straight line 12 extends through the midpoint of the quadrangle parallel to the side edges. In this way two parallel property bands 2*a* and 2*b* are formed. The parallel property bands 2*a* and 2*b* may again be displaced parallel to said straight line 12. The parallel property bands 2*a* and 2*b* extend horizontally or vertically. Furthermore, this quadrangle possesses a diagonal 4 or 7 and two straight lines 8 and 9 or 10 and 11 extending in parallel through the side length midpoints, and thus additional parallel property bands 3*a* and 3*b* differing alternatingly only in one property mode as do 2*a* and 2*b*. The parallel property bands 2*a* and 2*b* may be displaced parallel to the straight line 12 which extends through the side length midpoints. The parallel property bands 3*a* and 3*b* may likewise be displaced to the diagonal 4 or 7. These property bands 2*a*, 2*b*, 3*a*, 3*b* again differ in one property mode wherein the property is expressed alternatingly in pairs of different degrees of lightness, color, saturation, pattern, structure or gloss. The diagonals 4 and 7 and the straight lines 8, 9, 10, 11 and 12 may be configured as in the preceding embodiment as borderlines of the property bands 2*a*, 2*b*, 3*a*, 3*b*, continuously or discontinuously, high in contrast, or as fuzzy transition. The borderlines between the pairs of property bands 2*a*, 2*b*, 3*a* and 3*b* may thus be configured alternatingly as a contrasting line 5 and/or as a fuzzy transition 6. The property bands 2*a*, 2*b*, 3*a*, 3*b* are likewise defined irregularly or regularly. However, each property band 2*a*, 2*b*, 3*a*, 3*b* is in itself homogenous in one property mode. In this way one property of the camouflage pattern area is present 40 to 60%, preferably 50% each in one mode and 40 to 60%, preferably 50% each, in another mode.

To further enhance camouflage, another embodiment provides for the scheme area 1 to also be configured as a quadrangle. Again the side lengths of the quadrangle correspond to the maximal height or maximal width of the object to be camouflaged and/or of the area to be camouflaged. This quadrangle possesses two intersecting diagonals 4 and 7 extending through the quadrangle midpoint and four straight lines 8, 9, 10 and 11 extending in parallel through the side length midpoints and thus forms parallel property bands 2*a*, 2*b* and 3*a*, 3*b*, with the property bands 2*a* and 2*b* extending parallel to the diagonal 4 and the property bands 3*a* and 3*b*, parallel to the diagonal 7, and the property bands 2*a*, 2*b*, 3*a*, 3*b* differ alternatingly only in one property mode. These parallel property bands 2*a*, 2*b*, 3*a*, 3*b* may be displaced parallel to the diagonals 4 and 7. The property of these property bands 2*a*, 2*b*, 3*a*, 3*b* are present in alternating modes in two different degrees each of lightness and/or color and/or saturation and/or pattern and/or structure and/or gloss and each property band 2*a*, 2*b*, 3*a*, 3*b* is per se homogenous in said property. In this way one property of the camouflage pattern area 1 is present 40 to 60%, preferably 50% each in one mode, and 40 to 60%, preferably 50% each, in another mode. The diagonals 4 and 7 and the straight lines 8, 9, 10, and 11 are configured as borderlines of the property bands 2*a*, 2*b*, 3*a* and 3*b*, continuously or discontinuously, high in contrast, or as fuzzy transition. The property bands 2*a*, 2*b*, 3*a* and 3*b* are defined irregularly or regularly. The borderlines between the pairs of property bands 2*a*, 2*b*, 3*a* and 3*b* may thus be configured alternatingly as a contrasting line 5 and/or as a fuzzy transition 6. However, each property band 2*a*, 2*b*, 3*a*, 3*b* is in itself homogenous in one property mode.

The angle of the intersecting property bands 2*a* or 2*b* and 3*a* or 3*b* may be between above zero degrees and beneath 90 degrees. The pairs of property bands 2*a*, 2*b* and 3*a*, 3*b* of same property extend in parallel.

The camouflage scheme can be transferred to existing camouflage patterns and/or incorporated into existing camouflage patterns. The camouflage scheme can furthermore be applied to the entire spectrum of electromagnetic waves. In special cases the camouflage pattern may extend continuously over the surface of the object to be camouflaged without interruption. It does not matter how the pattern is generated (printing, spraying, nano-technology, electronics, radiation).

Figure 14:
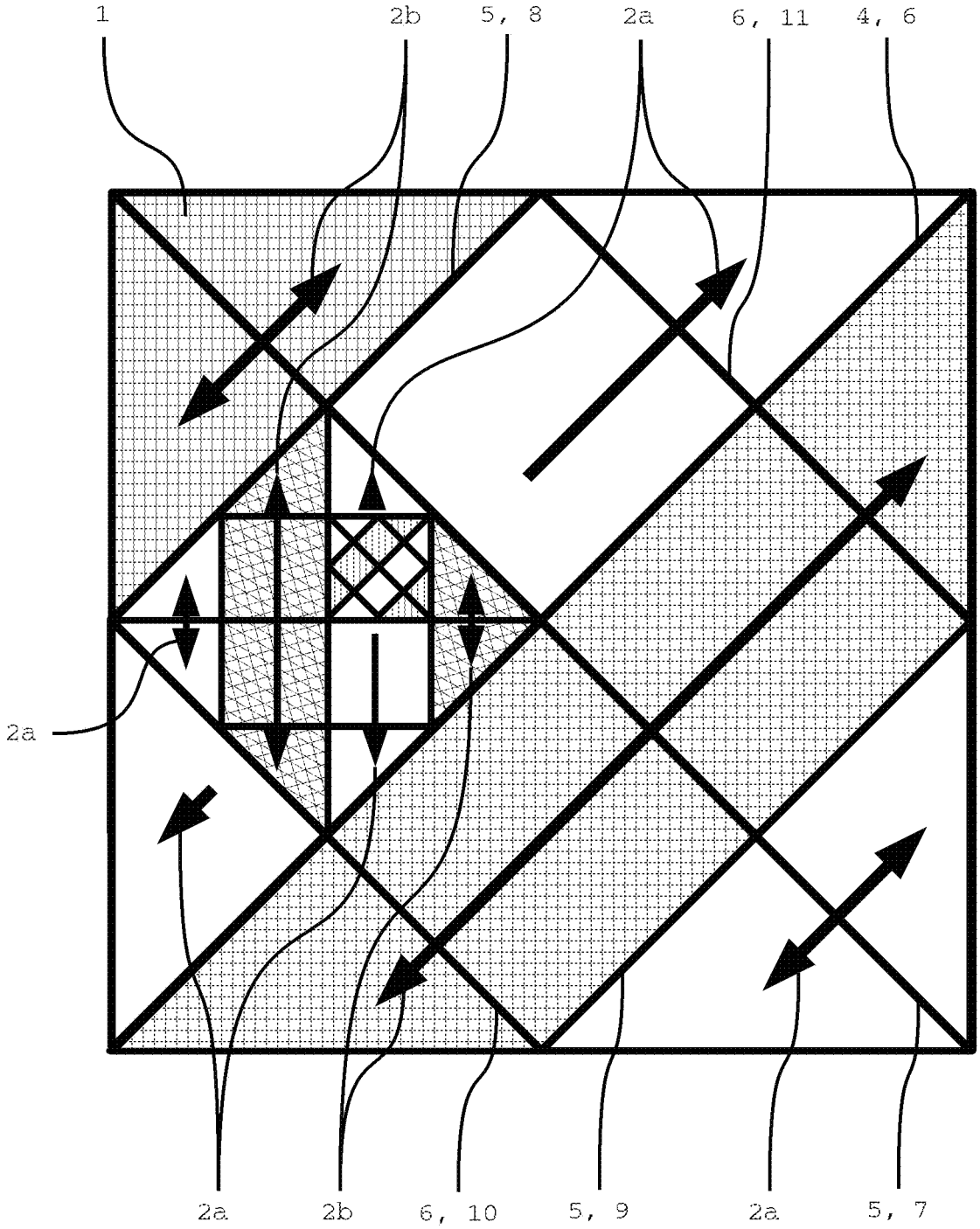
FIG. 14 is a schematic illustration of a detail of the fractal structure of the camouflage pattern.
Figure 15:
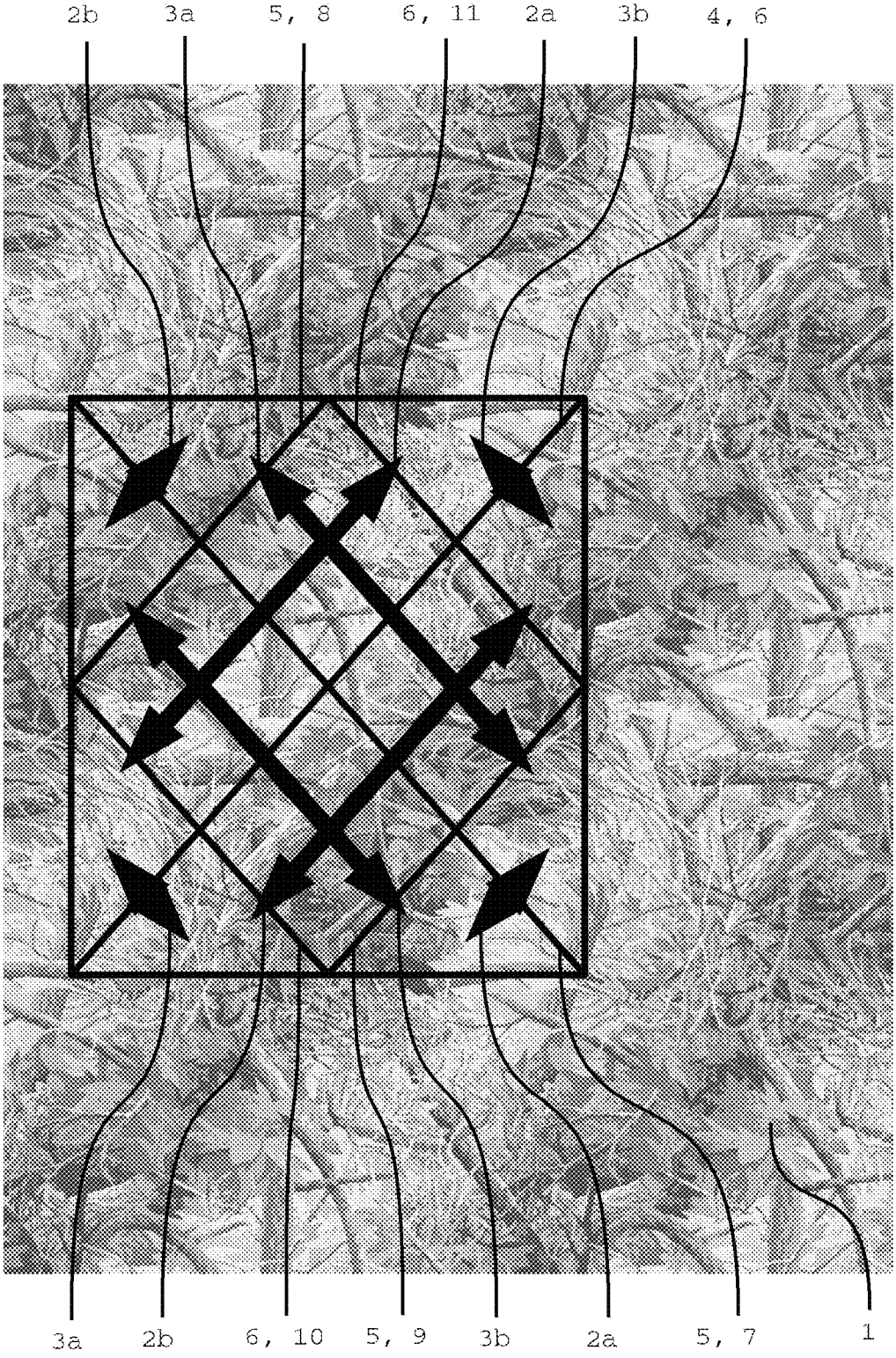
FIG. 15 is a schematic illustration of an embodiment of the basic camouflage scheme as a continuous, repeating camouflage pattern for use with objects, such as textiles.
Figure 16:
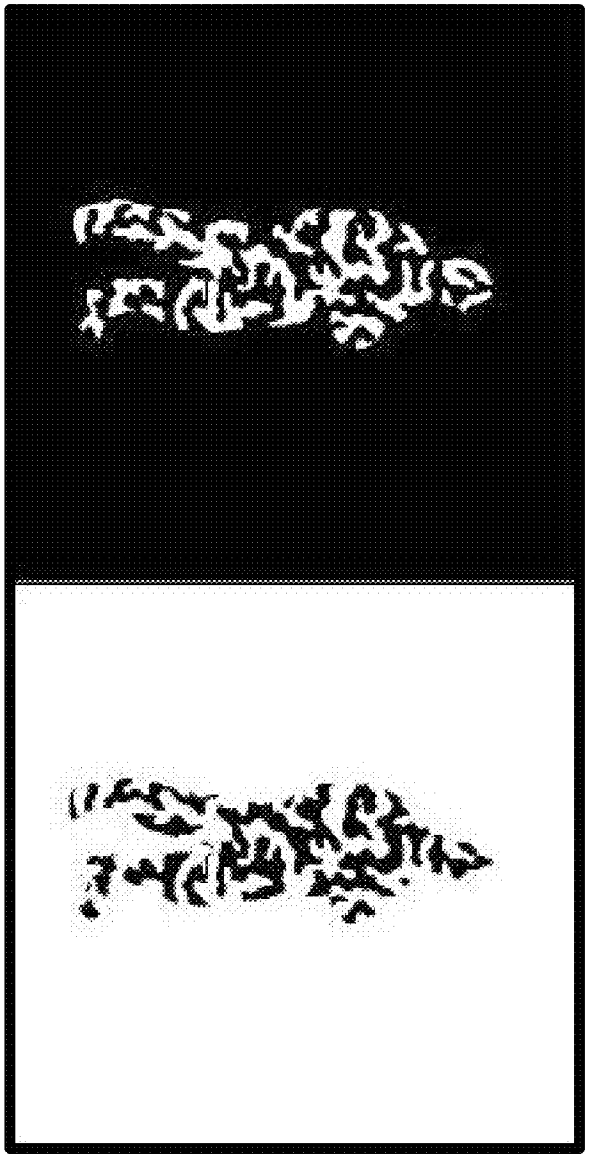
FIG. 16 is a schematic illustration of an exemplary color mixture generated by high frequency, adjacent hues in black and white, with an object placed against black and white backgrounds.
Figure 17:
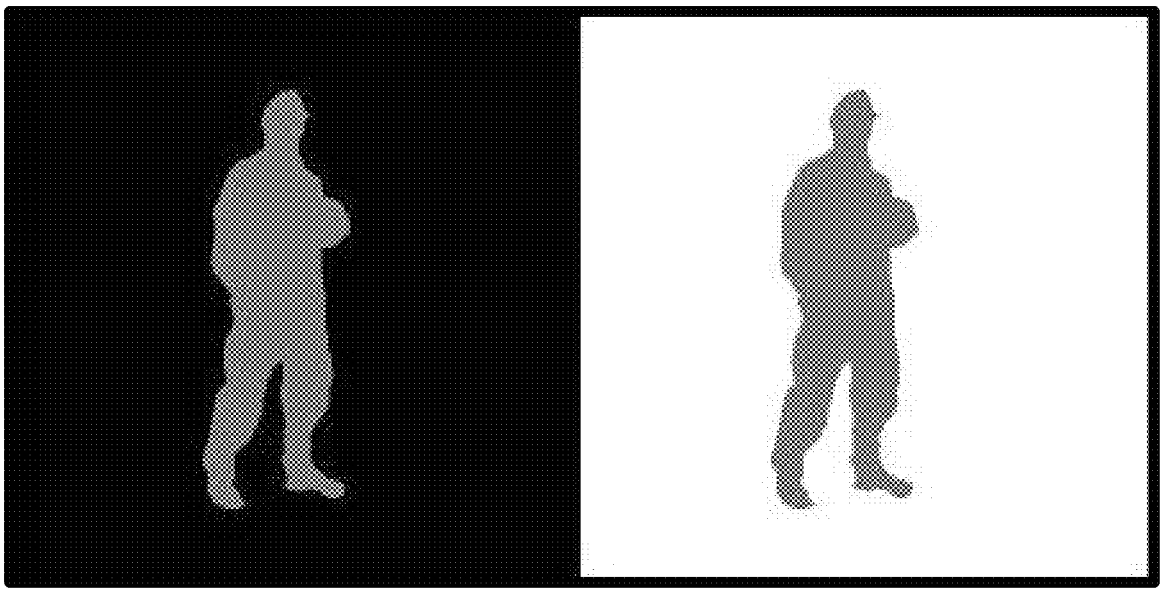
FIG. 17 is a schematic illustration of a blended color having one tonal value over the entire body that is gray blended from black and white, against a black or white background respectively.

To achieve a consistently good camouflage effect independently of the distance between object and observer, zones may be generated by superimposing pairs of property bands 2*a*, 2*b* with intersecting pairs of property bands 3*a*, 3*b*, representing intersections of the pairs of property bands, these zones can then be divided further into sub-zones, again by means of intersecting parallel pairs of property bands which sub-zones are then again subdivided into sub-sub-zones, and so forth. In this way fractal interweaving is obtained that may be continued infinitely so as to result in a continuous camouflage effect across any distance. This fractal interweaving is illustrated in FIG. 14. In the camouflage pattern area 1, four squares/quadrangles and eight half squares/quadrangles are created through the diagonals 4 and 7 and their parallels 8, 9, 10 and 11. One of these is illustrated in full, showing the fractal structure in representation of the other quadrangles in the camouflage pattern area 1: The camouflage pattern area 1 is repeated in this quadrangle in its entirety. This repeat shows, again exemplarily for the other quadrangles of this repeat, another repeat of the camouflage pattern area 1. The camouflage pattern area 1 can again be entirely incorporated into each repeat. These repeats can be continued infinitely for each quadrangle present in the camouflage pattern area 1. For the sake of clarity this is shown only exemplarily in FIG. 14 by one quadrangle of the camouflage pattern area 1.

Figure 8:
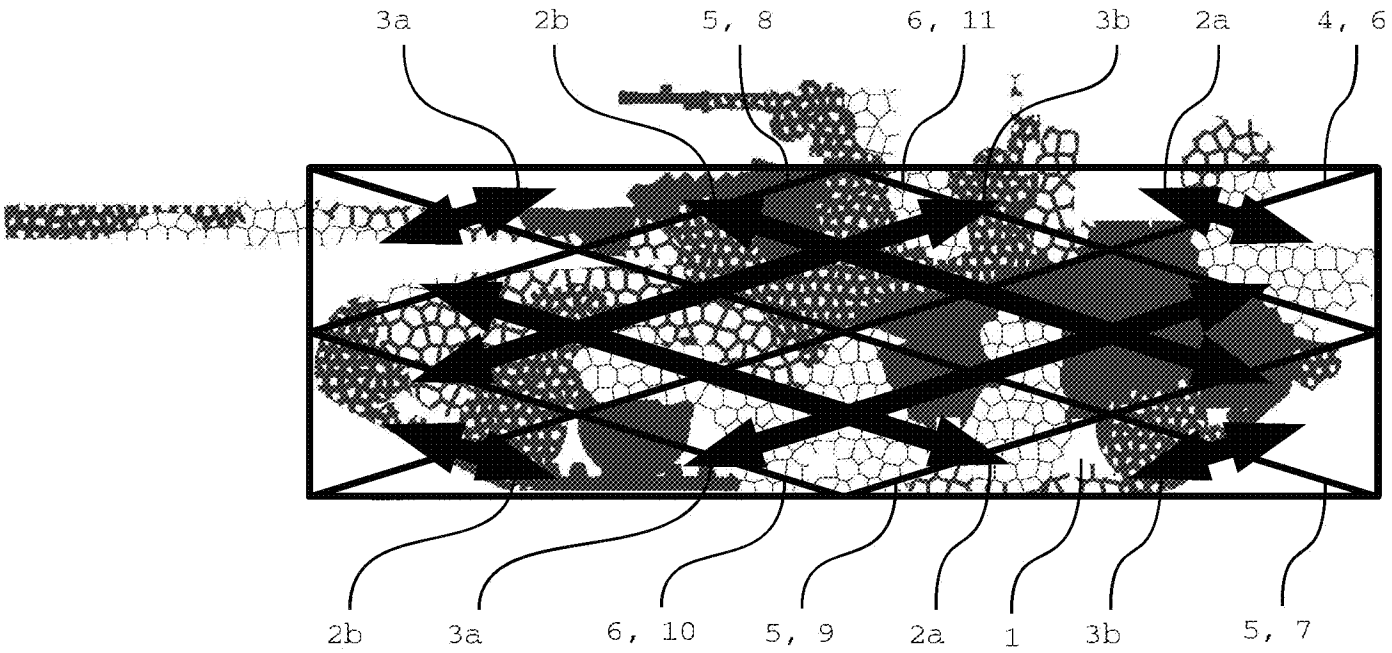
FIG. 8 is a schematic illustration of a camouflage pattern applied and limited to the essential basic vehicle shape namely, turret and substructure with chassis, on a tank in a side view from the left, illustrating the bands and reference lines for explaining the scheme.
Figure 9:
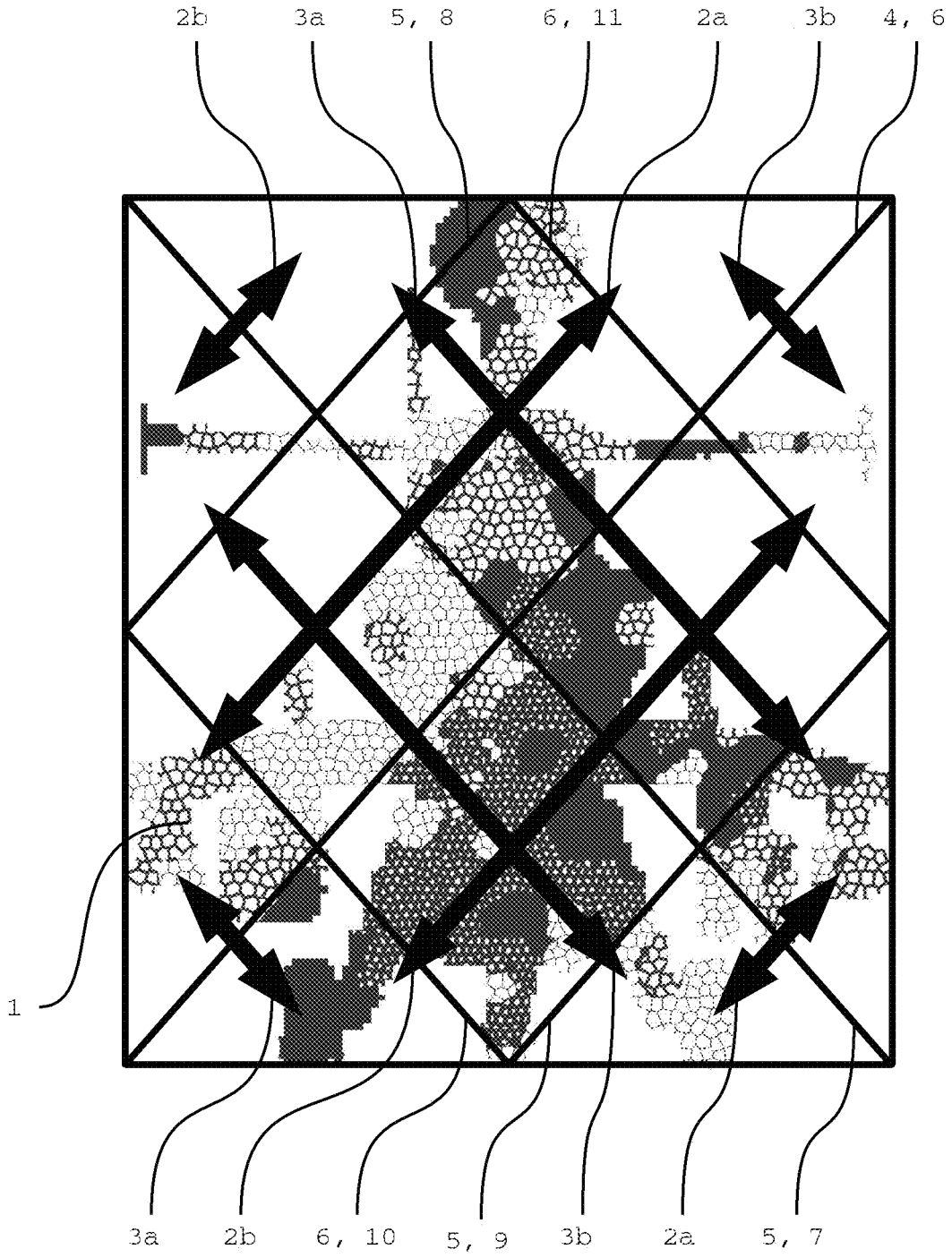
FIG. 9 is a schematic illustration of a camouflage pattern on a helicopter in a front view, illustrating the bands and reference lines for explaining the scheme.

The FIGS. 1 to 7 and 9 show the camouflage scheme applied to the camouflage pattern of different vehicles and FIG. 8, to the turret and the trough and chassis of a tank. A quadrangle is placed over the vehicle or section to be camouflaged as an aid for configuring the camouflage pattern area. The side lengths of this quadrangle are the (maximal) height or width of the object to be camouflaged. Once with (FIG. 1 to FIG. 6) and once without (FIG. 8) small parts (barrel, additional tank, machine gun, etc.). A similar process is conceivable in FIG. 7.

FIG. 10 shows camouflage clothing comprising a camouflage pattern composition. Both pants and coat form one object to be camouflaged. The camouflage pattern area is subdivided into property bands 2*a* and 2*b* extending diagonally in parallel differing in one property mode which property is present in two different degrees of lightness, color, saturation, pattern, structure, or gloss. The diagonals 4 and their parallels 8 and 9 form borderlines. Said borderlines of the property bands 2*a* and 2*b* may be configured continuously or discontinuously, as a contrasting line 5, or as a fuzzy transition 6. The property bands 2*a* and 2*b* are defined irregularly.

Figure 11:
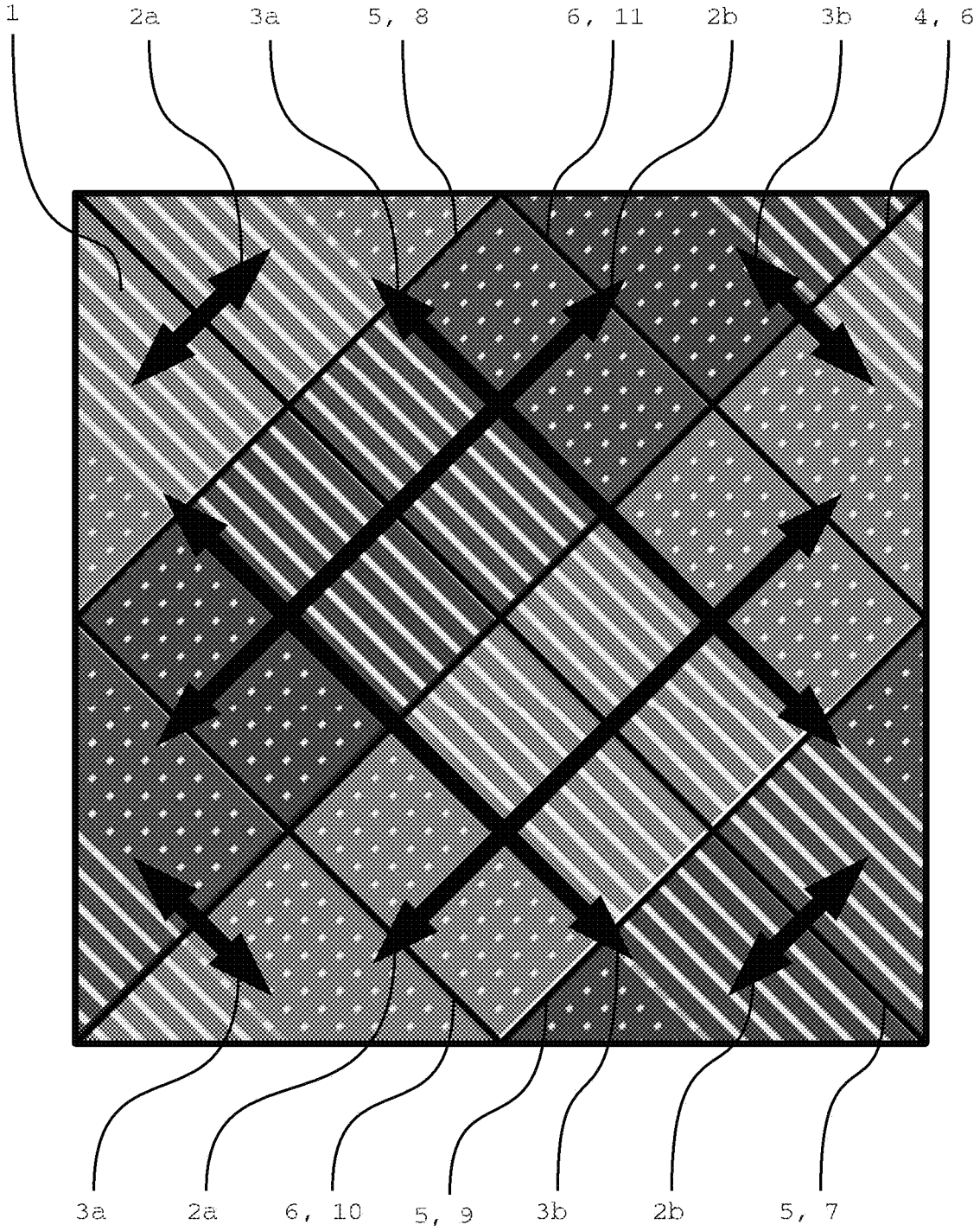
FIG. 11 is a schematic illustration of a camouflage pattern in a quadratic area, illustrating diagonal bands of combined properties and with reference lines for explaining the scheme.
Figure 12:
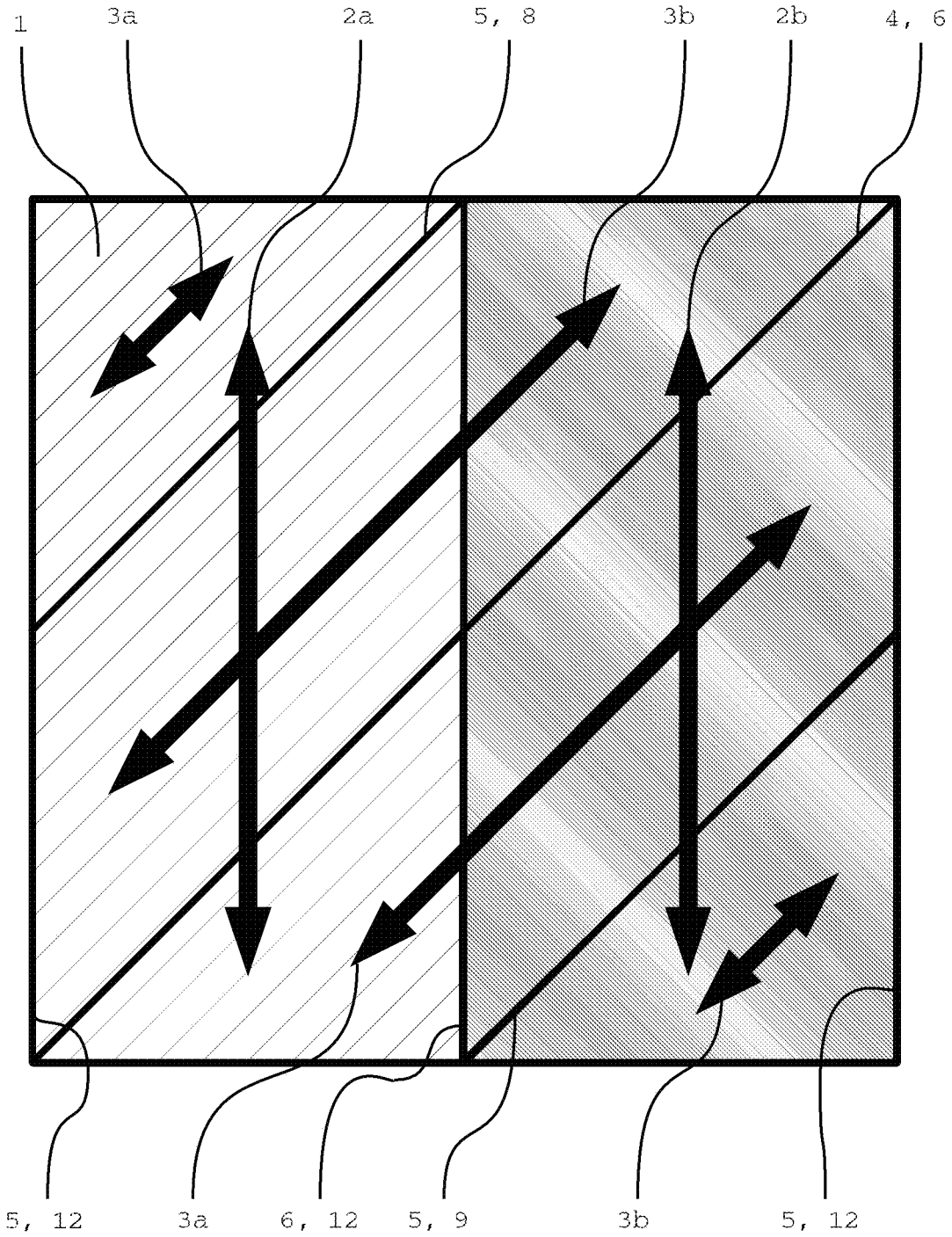
FIG. 12 is a schematic illustration of a camouflage pattern in a quadratic area, illustrating diagonal and vertical bands and with reference lines for explaining the scheme.
Figure 13:
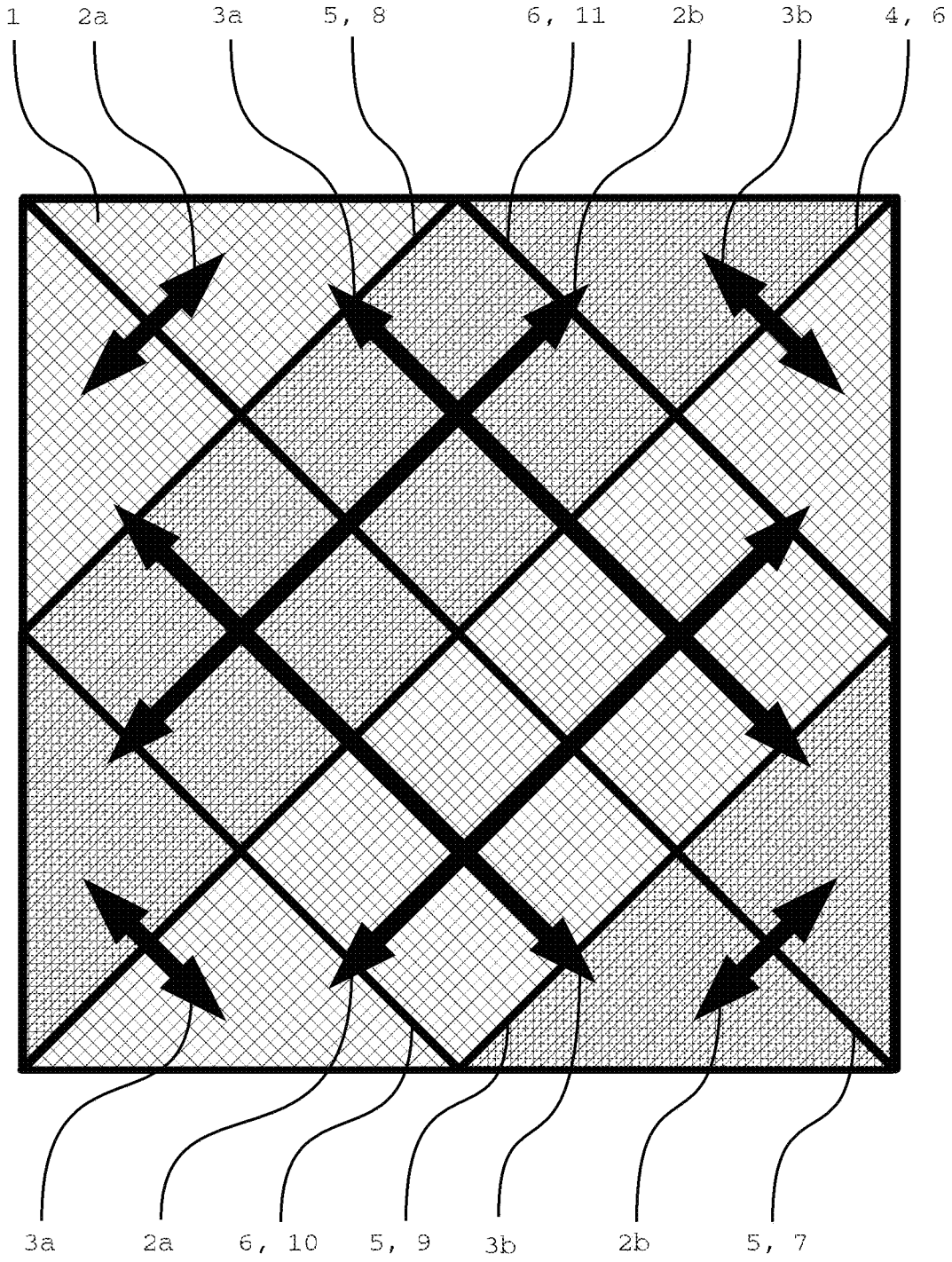
FIG. 13 is a schematic illustration of a camouflage pattern in a quadratic area, illustrating diagonal, parallel property bands of different modes of one property, intersecting with parallel property bands of different modes of another property, with reference lines for explaining the scheme.
Figure 20:
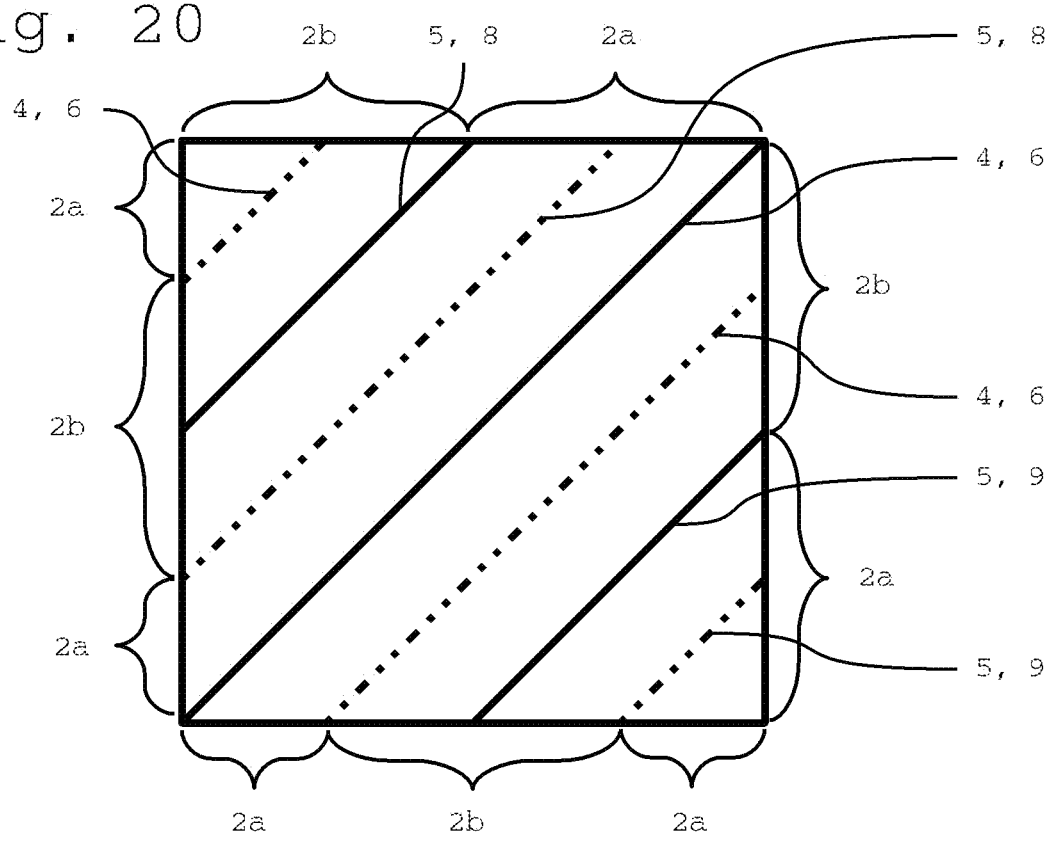
FIG. 20 is a schematic illustration of a camouflage pattern in a quadratic area, illustrating diagonally extending bands with reference lines for explaining the scheme with a displaced band, which is illustrated in dashed lines.
Figure 21:
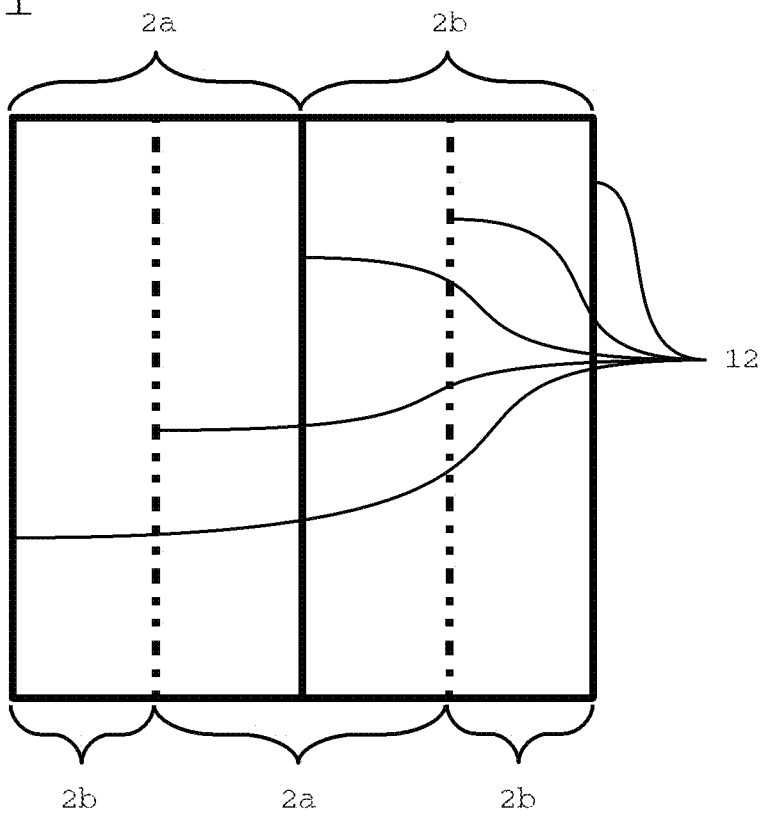
FIG. 21 is a schematic illustration of a camouflage pattern in a quadratic area, illustrating vertically extending bands and with reference lines for explaining the scheme with a displaced band, which is illustrated in dashed lines.
Figure 22:
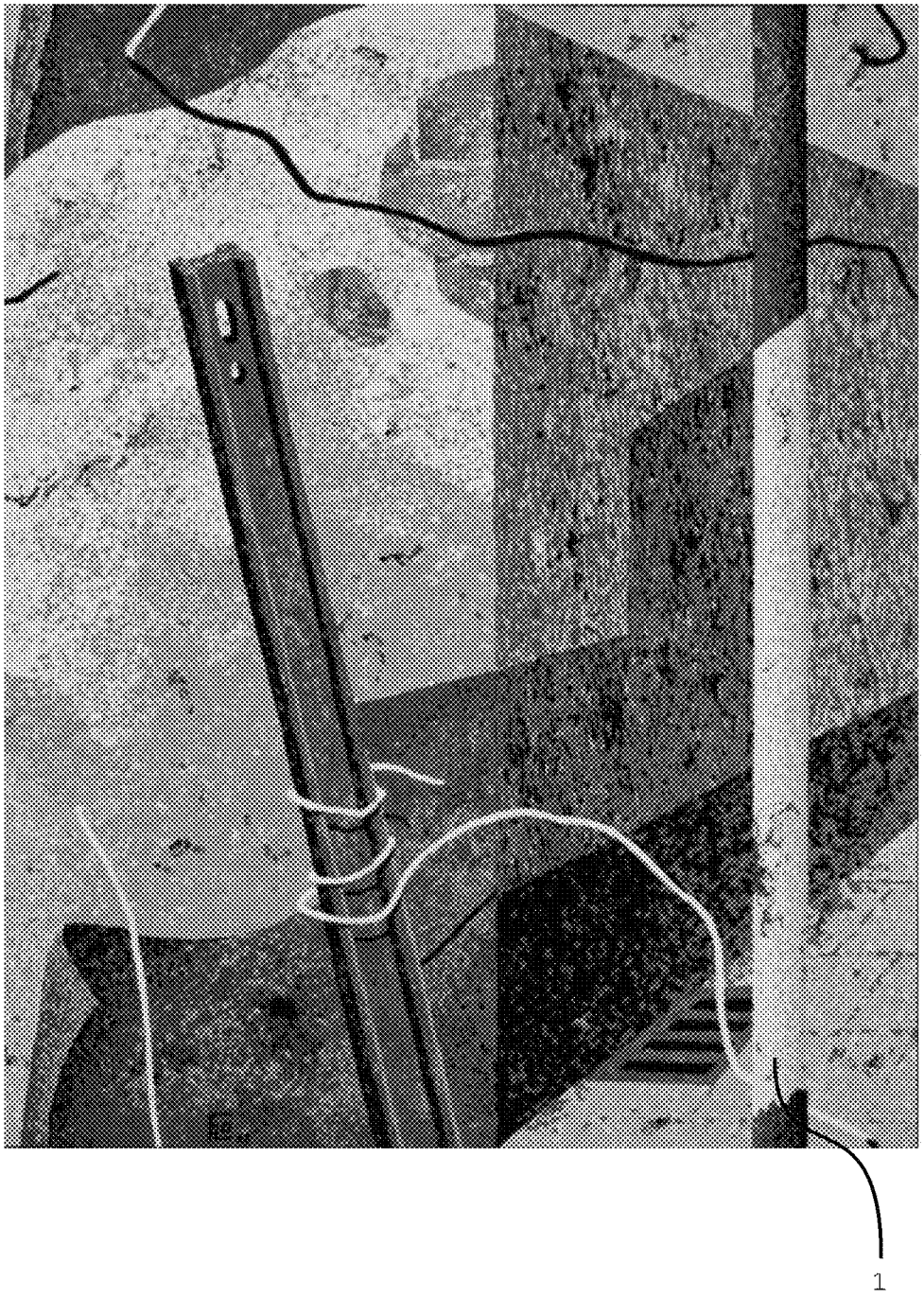
FIG. 22 is a schematic illustration of an "urban" or "construction" camouflage pattern.
Figure 23:
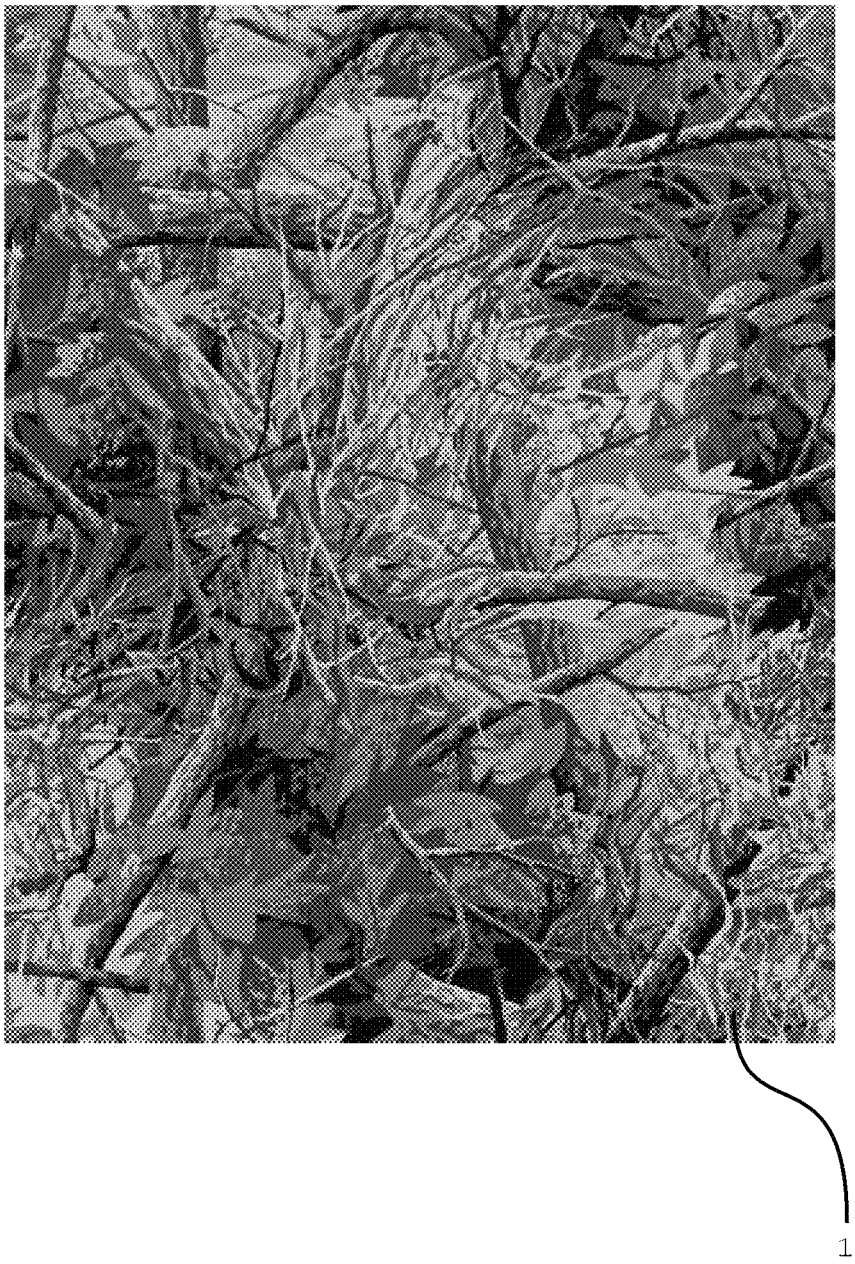
FIG. 23 is a schematic illustration of a "wood pattern" or "wood" camouflage pattern.
Figure 24:
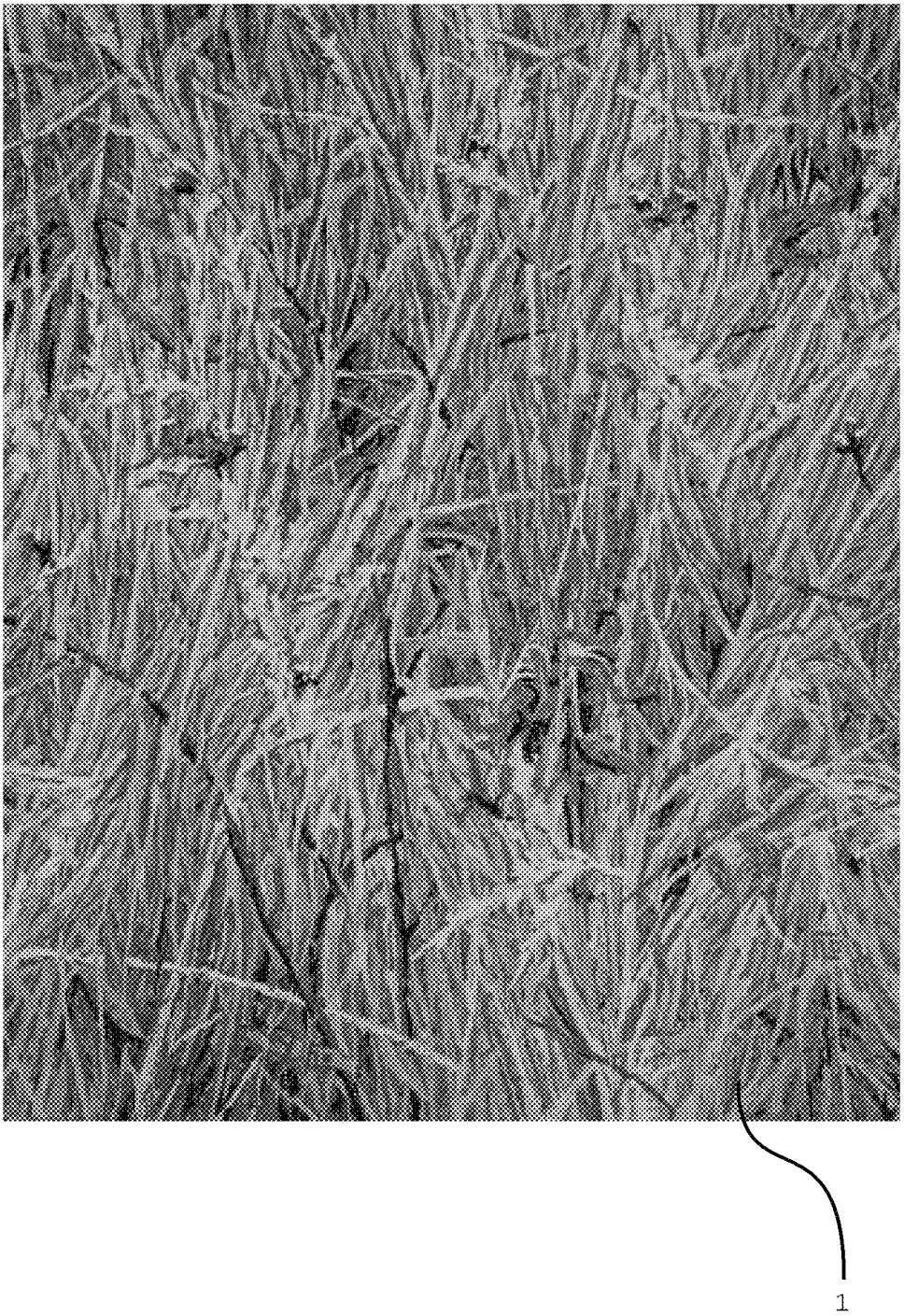
FIG. 24 is a schematic illustration of a "meadow pattern" or "plain" camouflage pattern.
Figure 25:
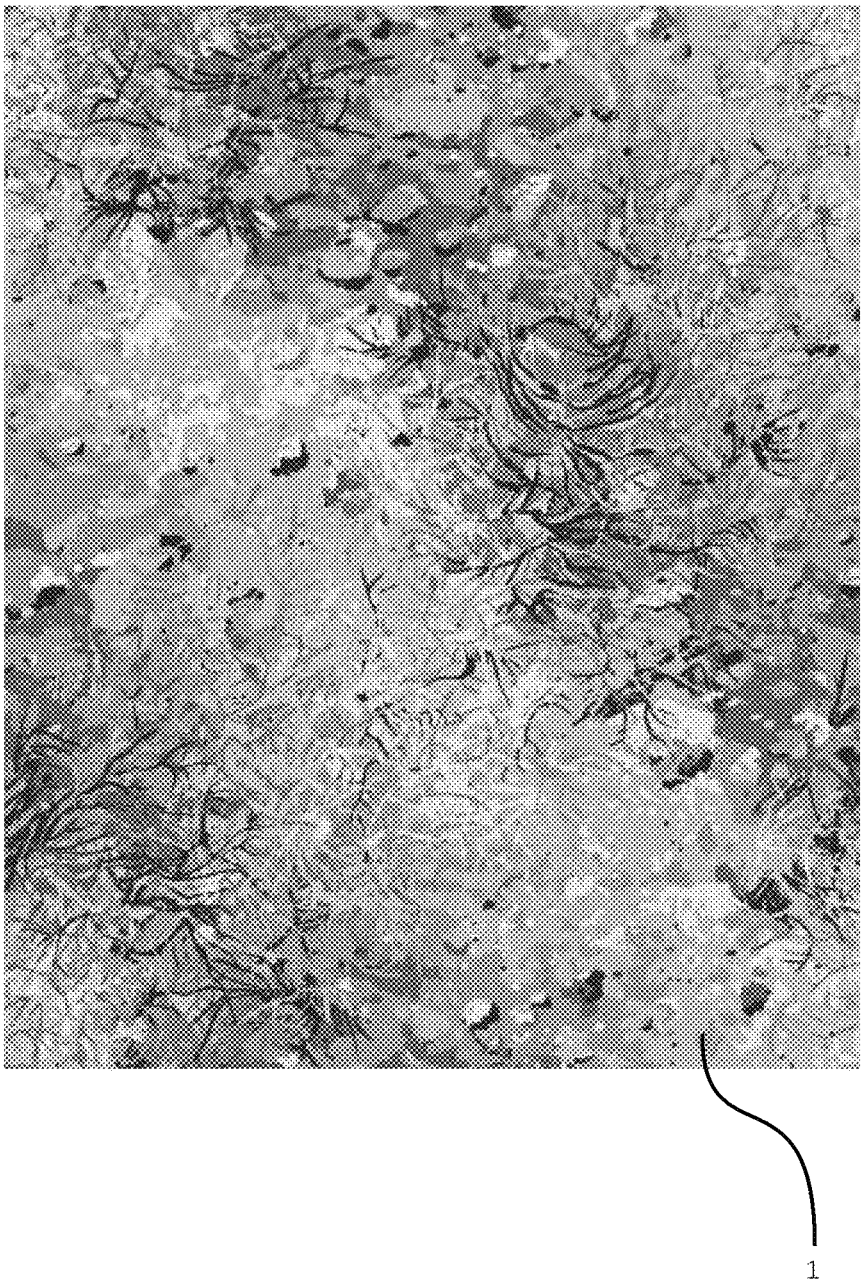
FIG. 25 is a schematic illustration of a "desert pattern" or "desert" camouflage pattern.
Figure 26:
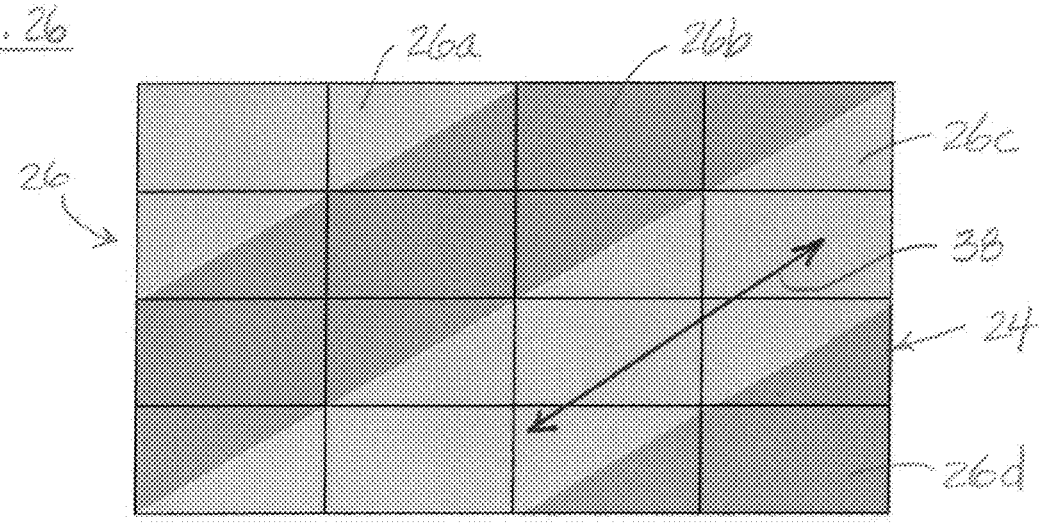
FIG. 26 is a schematic illustration of an area of a body showing first bands extending in a first running direction across the area.
Figure 27:
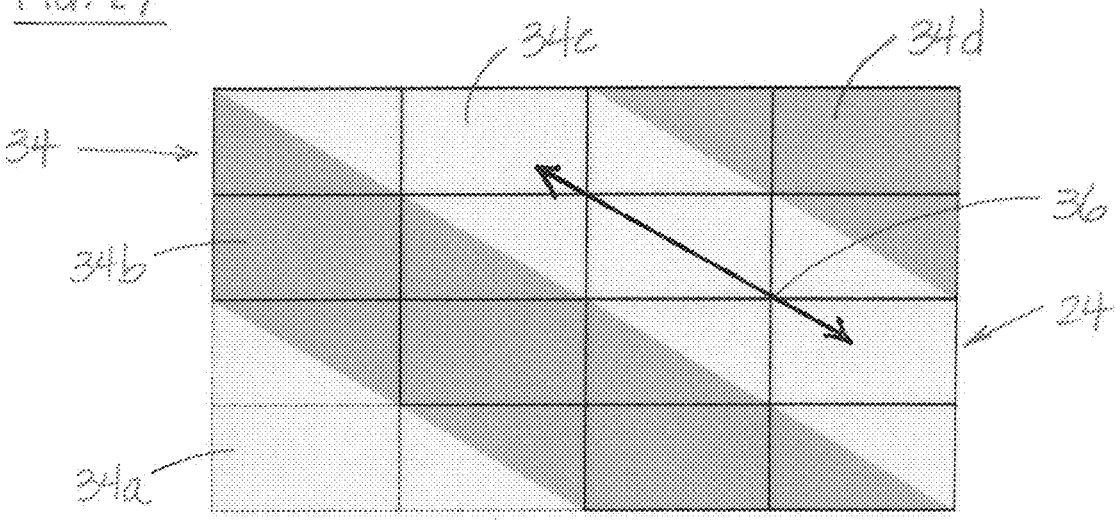
FIG. 27 is a schematic illustration of an area of a body showing second bands extending in a second running direction across the area.

The FIGS. 11 to 13 show the camouflage scheme simplified, as an area. The camouflage pattern areas 1 are configured as quadrangles with the quadrangle side lengths corresponding to the maximal height or maximal width of the object to be camouflaged and/or the area to be camouflaged, said quadrangle serving as an aid in configuring the camouflage pattern area 1 according to the invention. To this end a diagonal 4 is used in FIG. 12 and two straight lines 8 and 9 extending in parallel thereto through the side length midpoints. FIG. 12 provides as a specific feature a straight line 12 extending parallel to the side edges through the midpoint of the quadrangle. Thus the diagonal 4 and the straight lines 8 and 9 form pairs of parallel property bands 3*a* and 3*b*, and the straight line 12 with the side edges of the quadrangle, pairs of parallel property bands 2*a* and 2*b*. These parallel property bands 2*a*, 2*b* and 3*a*, 3*b* may also be displaced parallel to the diagonal 4 or straight line 12. This displacement is illustrated exemplarily in the FIGS. 20 and 21.

Referring now to FIGS. 26 to 30D, an embodiment of the present camouflage scheme or camouflage pattern 20 is placed or positioned on a body of an object, such as the article of clothing 22 shown in FIG. 30A, and includes an area 24 having at least two alternating first bands 26 (26*a*, 26*b*, 26*c*, 26*d*) each having a first length and a first perceptible characteristic where the first bands 26 extend generally diagonally across the entire area 24 in a first direction 28. It should be appreciated that the first bands 26 may extend horizontally, vertically, diagonally or at any suitable angle across the area 24. In the illustrated example, the first perceptible characteristic is a color, such as brown, red, green, white or black, where the first bands 26 include a first color 30 and a second color 32, and the first bands 26 having the first and second colors are alternately positioned in the area 24, i.e., no first bands 26 having the same color are next to each other in the area 24. Also, the first and second colors 30, 32 extend along the entire first length of the respective first bands 26. It should be appreciated that the area 24 may cover at least part of the body and may also cover the entire body. It should further be appreciated that the area 24 may include one or a plurality of the first bands 26.

To complete the camouflage scheme or pattern 20, at least two second bands 34 (34*a*, 34*b*, 34*c*, 34*d*) each having a second length and a second perceptible characteristic, each extend generally diagonally across the entire area 24 in a second direction 36, where the first and second directions are different. It should be appreciated that the second bands 34 may extend horizontally, vertically, diagonally or at any suitable angle across the area 24. In the illustrated example, the second perceptible characteristic is shading, i.e., changing the lightness or darkness of a color, pattern, etc., where the second bands 34 include lighter and darker bands. As shown in FIG. FIG. 27, the second bands 34 include alternating lighter and darker bands that extend across the area in the second direction 36. Also, the second perceptible characteristic, i.e., shading, extends along the entire second length of the second bands 34. For example, the lighter shading and darker shading extends along the entire length of the respective second bands 34. It should be appreciated that the area 24 may include one or a plurality of the second bands 34.

Figure 28:
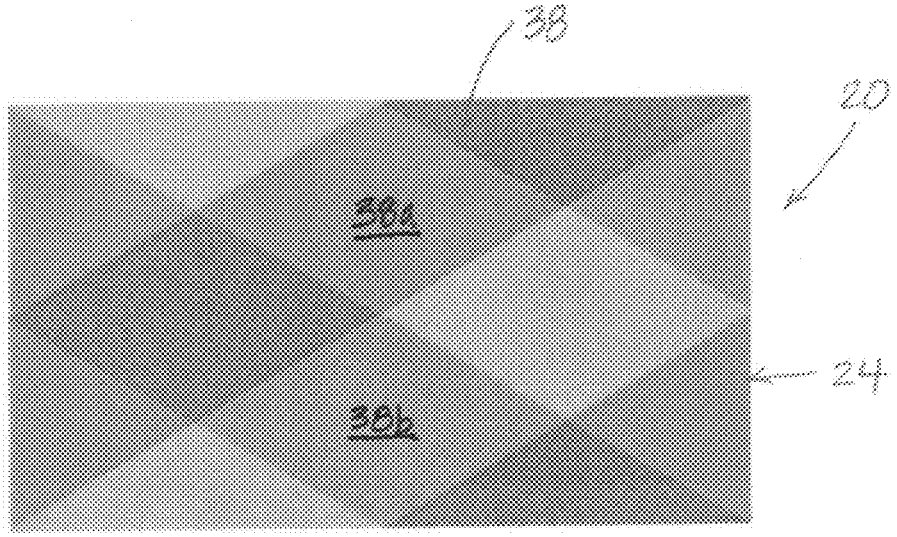
FIG. 28 is a schematic illustration showing a plurality of zones in an area of a body formed by the first bands of FIG. 26 overlapping the second bands of FIG. 27.

Referring to FIG. 28, the completed camouflage scheme or pattern 20 includes a combination of the first bands 26 (26*a*, 26*b*, 26*c*, 26*d*) and the second bands 34 (34*a*, 34*b*, 34*c*, 34*d*) where the first and second bands overlap each other to create zones 38 made of the combined or blended first and second perceptible characteristics of the first and second bands 26, 34. In other words, the zones 38 each include a combination of the first and second perceptible characteristics of the first and second bands 26, 34 that overlap each other. For example, zone 38*a* includes a lighter shade of the first color, which is a combination of the first color of the first band 26*b* and the light shading of the second band 34*c* overlapping each other in this zone. Another zone 38*b* includes a darker shade of the second color, which is a combination of the second color of the first band 26*c* and the darker shading of the second band 34*b* overlapping each other in this zone. It should be appreciated that the first and second perceptible characteristics may be the same perceptible characteristic, i.e., the first bands 26 and the second bands 34 each include a color where the color of the first and second bands may be the same or different, or different perceptible characteristics such as described above. It should also be appreciated that the first and second perceptible characteristics may be any suitable perceptible characteristics such as colors, hues, shading, patterns or combinations of perceptible characteristics.

Figure 29:
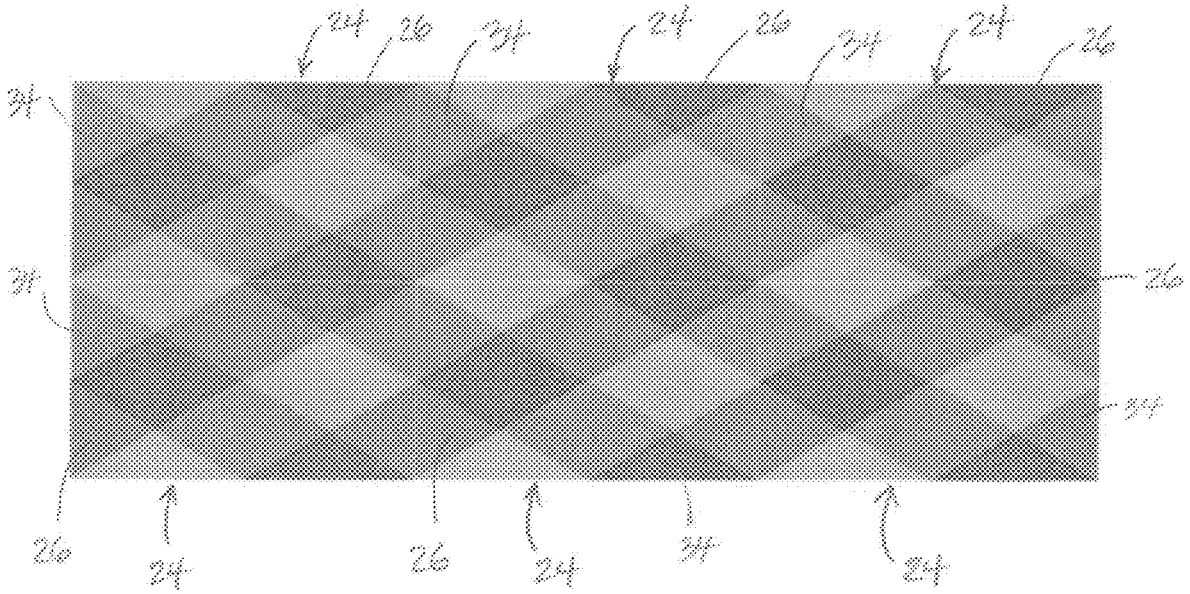
FIG. 29 is a schematic illustration showing a plurality of areas arranged adjacent to each other.

Referring to FIG. 29, in another embodiment, the camouflage scheme or pattern 40 includes a plurality of the above areas 24 that are positioned adjacent to each other on an article of clothing or on other objects such as vehicles, airplanes, boats or other suitable articles or objects. As shown in FIG. 29, the areas 24 each have the same overlapping first and second bands 26, 34. It should be appreciated that one or more of the areas 24 may have the same or different first and second bands 26, 34. For example, the first and second perceptible characteristics of the first and second bands 26, 34 in each of the areas 24 may be the same. As another example, the first and second perceptible characteristics of the first and second bands 26, 34 in at least two of the areas 24 are different.

Referring to FIGS. 30A, 30B, 30C and 30D, the camouflage scheme or pattern 20 described above is applied to a body such as an article of clothing 22. In this example embodiment, the article of clothing 22 has a designated area 40 defined by a length 42 and width 44. At least two first bands 46 having a first length extending diagonally across the area 40 in a first direction 48. The first bands 46 have a first perceptible characteristic, which in this embodiment, is shading. For example, the first bands 46*a* are darker or include a darker shading and the first bands 46*b* are lighter or include a lighter shading. As shown in FIG. 30B, the lighter and darker shading extends along the entire length of the respective first bands 46*a*, 46*b* in the area 40.

Referring to FIG. 30C, at least two second bands 50 (50*a*, 50*b*) extend diagonally across the area 40 in a second direction 52, where the first direction 48 and the second direction 52 are different. The second bands 50 include a second perceptible characteristic, which is a color. As shown in the illustrated embodiment, some of the second bands 50*a* include a first color, i.e., a brown color, and other of the second bands 50*b* include a second color, i.e., a green color. Also, the first and second colors extend along the entire length of the respective second bands. As described below, the first and second bands 46, 50 overlap each other to form zones 54 (FIG. 30D), such as zones 54*a*, 54*b*, 54*c*, 54*d*, 54*e*, 54*f*, 54*g*, 54*h* and 54*i*, which include combinations or blending of the first and second perceptible characteristics of the overlapping first and second bands 46, 50. It should be appreciated that the first bands 46 may overlap the second bands 50 or the second bands 50 may overlap the first bands 46.

FIG. 30C shows the different zones 54*a*, 54*b*, 54*c*, 54*d*, 54*e*, 54*f*, 54*g*, 54*h* and 54*i*, in the area 40 on the article of clothing 22. Certain zones have a light green color, such as zones 54*a*, 54*c* and 54*i*, which is a combination, blending or mixing of the first perceptible characteristic of the first bands 46*b*, which is a light shading, and the second perceptible characteristic of the second bands 50*b*, which is a green color. Also, certain zones 54*d*, 54*f* have a light brown color, which is a combination, blending or mixing of the first perceptible characteristic of the first bands 46*b*, which is a dark shading, and the second perceptible characteristic of the second bands 50*a*, which is a brown color.

Alternatively, zones 54*b*, 54*h* have a dark green color, which is a combination, blending or mixing of the first perceptible characteristic of the first bands 46*a*, which is dark shading, and the second perceptible characteristic of the second bands 50*b*, which is a green color. Similarly, zones 54*e*, 54*g* have a dark brown color, which is a combination, blending or mixing of the first perceptible characteristic of the first bands 46*a*, which is a dark shading, and the second perceptible characteristic of the second bands 50*a*, which is a brown color.

Referring to FIGS. 31A, 31B, 31C and 31D, another embodiment of the camouflage scheme or pattern 20 is applied to a body such as the article of clothing 22. In this example embodiment, the article of clothing 22 has a designated area 40 defined by a length 42 and width 44. At least two first bands 46 having a first length extending diagonally across the area 40 in a first direction 48. The first bands 46 have a first perceptible characteristic, which in this embodiment, is shading. For example, the first bands 46*a* are darker or include a darker shading and the first bands 46*b* are lighter or include a lighter shading. As shown in FIG. 31B, the lighter and darker shading extends along the entire length of the respective first bands 46*a*, 46*b* in the area 40.

Referring to FIG. 31C, at least two second bands 50 (50*a*, 50*b*) extend diagonally across the area 40 in a second direction 52, where the first direction 48 and the second direction 52 are different. The second bands 50 include a second perceptible characteristic, which is a color. As shown in the illustrated embodiment, some of the second bands 50*a* include a first color, i.e., a brown color, and other of the second bands 50*b* include a second color, i.e., a green color. Note that the hue of the brown color and the green color in this embodiment is different from the hue of the brown and green colors of the above embodiment. As shown in the illustrated embodiment, the first and second colors extend along the entire length of the respective second bands. As described below, the first and second bands 46, 50 overlap each other to form zones 54 (FIG. 31D), such as zones 54*a*, 54*b*, 54*c*, 54*d*, 54*e*, 54*f*, 54*g*, 54*h* and 54*i*, which include combinations or blending of the first and second perceptible characteristics of the overlapping first and second bands 46, 50. It should be appreciated that the first bands 46 may overlap the second bands 50 or the second bands 50 may overlap the first bands 46.

FIG. 31C shows the different zones 54*a*, 54*b*, 54*c*, 54*d*, 54*e*, 54*f*, 54*g*, 54*h* and 54*i*, in the area 40 on the article of clothing 22. Certain zones have a light green color, such as zones 54*a*, 54*c* and 54*i*, which is a combination, blending or mixing of the first perceptible characteristic of the first bands 46*b*, which is a light shading, and the second perceptible characteristic of the second bands 50*b*, which is a green color. Also, certain zones 54*d*, 54*f* have a light brown color, which is a combination, blending or mixing of the first perceptible characteristic of the first bands 46*b*, which is a dark shading, and the second perceptible characteristic of the second bands 50*a*, which is a brown color.

Alternatively, zones 54*b*, 54*h* have a dark green color, which is a combination, blending or mixing of the first perceptible characteristic of the first bands 46*a*, which is dark shading, and the second perceptible characteristic of the second bands 50*b*, which is a green color. Similarly, zones 54*e*, 54*g* have a dark brown color, which is a combination, blending or mixing of the first perceptible characteristic of the first bands 46*a*, which is a dark shading, and the second perceptible characteristic of the second bands 50*a*, which is a brown color.

Referring to FIGS. 32A, 32B, 32C and 32D, a further embodiment of the camouflage scheme or pattern 20 is applied to a body such as the article of clothing 22. In this example embodiment, the article of clothing 22 has a designated area 40 defined by a length 42 and width 44. At least two first bands 46 having a first length extending diagonally across the area 40 in a first direction 48. The first bands 46 have a first perceptible characteristic, which in this embodiment, is shading. For example, the first bands 46*a* are darker or include a darker shading and the first bands 46*b* are lighter or include a lighter shading. As shown in FIG. 32B, the lighter and darker shading extends along the entire length of the respective first bands 46*a*, 46*b* in the area 40.

Referring to FIG. 32C, at least two second bands 50 (50*a*, 50*b*) extend diagonally across the area 40 in a second direction 52, where the first direction 48 and the second direction 52 are different. The second bands 50 include a second perceptible characteristic, which is a color. As shown in the illustrated embodiment, some of the second bands 50*a* include a first color, i.e., a brown color, and other of the second bands 50*b* include a second color, i.e., a green color. Note that the hue of the brown color and the green color in this embodiment and the pattern (branches and leaves) are different from the hue of the brown and green colors, and the pattern, of the above embodiments. As shown in the illustrated embodiment, the first and second colors extend along the entire length of the respective second bands. As described below, the first and second bands 46, 50 overlap each other to form zones 54 (FIG. 32D), such as zones 54*a*, 54*b*, 54*c*, 54*d*, 54*e*, 54*f*, 54*g*, 54*h* and 54*i*, which include combinations or blending of the first and second perceptible characteristics of the overlapping first and second bands 46, 50. It should be appreciated that the first bands 46 may overlap the second bands 50 or the second bands 50 may overlap the first bands 46.

FIG. 32C shows the different zones 54*a*, 54*b*, 54*c*, 54*d*, 54*e*, 54*f*, 54*g*, 54*h* and 54*i*, in the area 40 on the article of clothing 22. Certain zones have a light green color, such as zones 54*a*, 54*c* and 54*i*, which is a combination, blending or mixing of the first perceptible characteristic of the first bands 46*b*, which is a light shading, and the second perceptible characteristic of the second bands 50*b*, which is a green color. Also, certain zones 54*d*, 54*f* have a light brown color, which is a combination, blending or mixing of the first perceptible characteristic of the first bands 46*b*, which is a dark shading, and the second perceptible characteristic of the second bands 50*a*, which is a brown color.

Alternatively, zones 54*b*, 54*h* have a dark green color, which is a combination, blending or mixing of the first perceptible characteristic of the first bands 46*a*, which is dark shading, and the second perceptible characteristic of the second bands 50*b*, which is a green color. Similarly, zones 54*e*, 54*g* have a dark brown color, which is a combination, blending or mixing of the first perceptible characteristic of the first bands 46*a*, which is a dark shading, and the second perceptible characteristic of the second bands 50*a*, which is a brown color.

In the above embodiments, the above combinations of the first and second perceptible characteristics of the overlapping first and second bands 46, 50 provides an area 40 on an object or article of clothing that forms a unique camouflage scheme or pattern 20 to enable a wearer of the article of clothing or an object, such as a vehicle, boat or airplane, to blend in with any surrounding environment and/or terrain.

Figure 33:
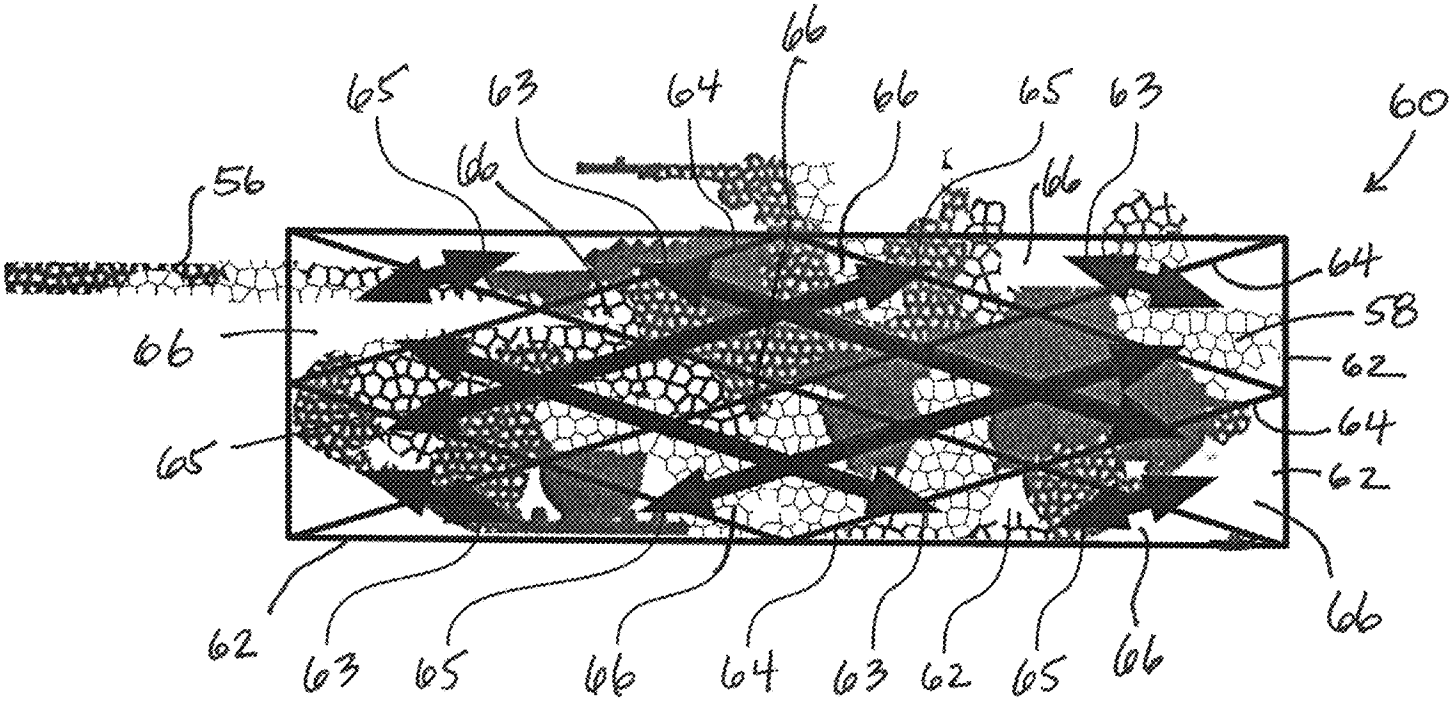
FIG. 33 is a schematic illustration of a camouflage pattern on a tank, illustrating the bands and reference lines for forming the camouflage pattern.

Referring to FIG. 33, in another embodiment, a camouflaging layer or a camouflaging coating 56 is applied to and adhered to a surface 58 of an object, such as a tank 60, or an article of clothing, a tent, a cover, a tarpaulin, a vehicle, an airplane or a boat or other suitable object, where at least one part of the coating is formed by at least two first bands or first elements 62 having a first length and running in a first direction 63, and at least two second bands or second elements 64 having a second length and running in a second direction 65, and where the first and second running directions are different as described above. In this embodiment, the first bands or first elements 62 each include a first perceptible characteristic and the second bands or second elements 64 each include a second perceptible characteristic where the first and second perceptible characteristics are different. For example, the first perceptible characteristic may by a color or a plurality of colors where the plurality of colors may be different types or hues of a single color, such as different shades of brown, or two or more different colors or hues of different colors. Similarly, the second perceptible characteristic may be the same or different types of shading, i.e., lightness or darkness. It should be appreciated that the first and second perceptible characteristics may be any suitable perceptible characteristics or combinations of perceptible characteristics. In this embodiment, the first bands 62 and the second bands 64 overlap each other and form zones 66 on the object. The zones 66 include combinations or blends of the first and second perceptible characteristics of the first and second bands as described above.

While particular embodiments of the present camouflaged object have been shown and described, it will be appreciated by those skilled in the art that changes and modifications may be made thereto without departing from the invention in its broader aspects and as set forth in the following claims.

The invention claimed is:

1. A camouflage object comprising:

a body having an area with a camouflage pattern, said camouflage pattern formed by:

at least two first property bands extending in a first running direction across said area and each having a first length and a first width, said at least two first property bands each including a first perceptible characteristic extending continuously along the entire first length of said at least two first property bands, said at least two first property bands being adjacent to each other and differ alternatingly in said first perceptible characteristic, said first perceptible characteristic is color;

at least one second property band extending in a second running direction across said area and having a second length and a second width, said at least one second property band including a second perceptible characteristic extending continuously along the entire second length of said at least one second property band, said at least one second property band at least partially overlapping said at least two first property bands, said second perceptible characteristic is shading; and a plurality of zones formed by the intersection of said at least two first property bands and said at least one second property band, said plurality of zones each having a zone perceptible characteristic that is formed by the combination of said first perceptible characteristic of said at least two first property bands and said second perceptible characteristic of said at least one second property band.

2. The camouflage object of claim 1, wherein said first and second property bands are aligned in a polygonal scheme area adapted to the size of the area of the object, said polygonal scheme area being dimensioned so that it covers an entirety of the area of the object.

3. The camouflage object of claim 2, wherein the dimensions of the polygonal scheme area and the widths of the first and second property bands are sized so that a maximum of only two of the first and second property bands extend along the entire width of the polygonal scheme area.

4. The camouflage object of claim 2, wherein said first and second property bands extend in a longitudinal direction of the first and second property bands extending along the entire width of the polygonal scheme area.

5. The camouflage object of claim 1, wherein the at least one second property band is comprised of a plurality of second property bands each having the second length, the second width and the second perceptible characteristic, said plurality of second property bands at least partially overlapping said at least two first property bands.

6. The camouflage object of claim 5, wherein said second property bands being adjacent to each other and differ alternatingly in said second perceptible characteristic.

7. The camouflage object of claim 1, wherein said first perceptible characteristic includes a first color and a second color.

8. The camouflage object of claim 7, wherein said first color and said second color are different hues of a single color.

9. The camouflage object of claim 7, wherein said first color and said second color are different colors.

10. The camouflage object of claim 1, wherein the body is a camouflage suit.

11. A camouflage object comprising:

a body;

a camouflage coating applied to a surface of said body, at least part of said coating formed with:

at least two first property bands extending in a first running direction and having a first length and a first width, said at least two first property bands being adjacent to each other and including a first perceptible characteristic extending continuously along the entire first length of said at least two first property bands, wherein said first perceptible characteristic of each of said at least two first property bands is different, said first perceptible characteristic is color;

at least one second property band extending in a second running direction and having a second length and a second width, said at least one second property band including a second perceptible characteristic extending continuously along the entire second length of said at least one second property band, said at least one second property band at least partially overlapping said at least two first property bands, said second perceptible characteristic is shading; and a plurality of zones formed by the intersection of said at least two first property bands and said at least one second property band, said plurality of zones each having a zone perceptible characteristic that is formed by the combination of said first perceptible characteristic of said at least two first property bands and said second perceptible characteristic of said at least one second property band.

12. The camouflage object of claim 11, wherein said coating is applied to an entire surface of said body.

13. The camouflage object of claim 11, wherein said first and second property bands are aligned in a polygonal scheme area adapted to the size of the area of the object, said polygonal scheme area being dimensioned so that it covers an entirety of the area of the object.

14. The camouflage object of claim 13, wherein the dimensions of the polygonal scheme area and the widths of the first and second property bands are sized so that a maximum of only two of the first and second property bands extend along the entire width of the polygonal scheme area.

15. The camouflage object of claim 13, wherein said first and second property bands extend in a longitudinal direction of the first and second property bands extending along the entire width of the polygonal scheme area.

16. The camouflage object of claim 11, wherein the at least one second property band is comprised of a plurality of second property bands each having the second length, the second width and the second perceptible characteristic, said plurality of second property bands at least partially overlapping said at least two first property bands.

17. The camouflage object of claim 16, wherein said second property bands being adjacent to each other and differ alternatingly in said second perceptible characteristic.

18. The camouflage object of claim 11, wherein said first perceptible characteristic includes a first color and a second color.

19. The camouflage object of claim 18, wherein said first color and said second color are different hues of a single color.

20. The camouflage object of claim 18, wherein said first color and said second color are different colors.

* * * * *